US007009100B2

(12) United States Patent
Ando

(10) Patent No.: US 7,009,100 B2
(45) Date of Patent: Mar. 7, 2006

(54) PERFORMANCE INSTRUCTION APPARATUS AND PERFORMANCE INSTRUCTION PROGRAM USED IN THE PERFORMANCE INSTRUCTION APPARATUS

(75) Inventor: Hitoshi Ando, Hachioji (JP)

(73) Assignee: Casio Computer Co., Ltd., Tokyo (JP)

( * ) Notice: Subject to any disclaimer, the term of this patent is extended or adjusted under 35 U.S.C. 154(b) by 218 days.

(21) Appl. No.: 10/637,348

(22) Filed: Aug. 7, 2003

(65) Prior Publication Data

US 2004/0244570 A1 Dec. 9, 2004

(30) Foreign Application Priority Data

Aug. 20, 2002 (JP) ..... 2002-239137
Sep. 19, 2002 (JP) ..... 2002-272467
Nov. 26, 2002 (JP) ..... 2002-341897

(51) Int. Cl.
*G10H 7/00* (2006.01)

(52) U.S. Cl. ..... 84/600; 84/470 R

(58) Field of Classification Search ..... 84/600–606, 84/609–612, 626, 634–636, 649–652, 666–668, 84/470 R, 477 R, 478, 662; 345/473–474; 348/155, 399; 463/7, 23, 36

See application file for complete search history.

(56) References Cited

U.S. PATENT DOCUMENTS 5,990,405 A * 11/1999 Auten et al. ..... 84/609
6,245,982 B1 * 6/2001 Suzuki et al. ..... 84/477 R
2001/0016510 A1 * 8/2001 Ishikawa et al. ..... 463/7
2003/0094092 A1 * 5/2003 Brinkman et al. ..... 84/609

FOREIGN PATENT DOCUMENTS

JP 7-36446 A 2/1995
JP 2000-352973 A 12/2000
JP 2001-282094 A 10/2001

* cited by examiner

*Primary Examiner*—David Martin
*Assistant Examiner*—Jianchun Qin
(74) *Attorney, Agent, or Firm*—Frishauf, Holtz, Goodman & Chick, P.C.

(57) ABSTRACT

A head mounting display of a goggle type has a display, on which a guide image representing a model performance manipulation and an eyesight image of a practitioner are displayed in a superimposed manner. The guide image is adjusted its display size and position to be displayed on the display based on an image of a keyboard portion included in the eyesight image. Further, resolution and number of colors of the eyesight image are adjusted so as to meet those of the guide image or an animation image, resulting in reduction of data to be processed. Further, a side eyesight image of a hand of the practitioner playing an instrument is taken from the side, and it is determined if the practitioner's hand in the side eyesight image coincides with a model hand posture defined by judgment data which represents model manipulation performed in synchronization with progress of a song.

17 Claims, 25 Drawing Sheets

FIG. 12

MAP

| NUMBER OF KEYS | PITCH | FREQUENCY (Hz) | NOTE No. | NUMBER OF BLACK KEYS | NUMBER OF WHITE KEYS |
|---|---|---|---|---|---|
| 88 | A0 | 27.5 | 21 | 36 | 52 |
| 73 | C1 | 32.7 | 24 | 30 | 43 |
| 76 | E1 | 41.2 | 28 | 31 | 45 |
| 61 | C2 | 65.4 | 36 | 25 | 36 |
| 49 | C3 | 130.8 | 48 | 20 | 29 |

PERFORMANCE INSTRUCTION APPARATUS AND PERFORMANCE INSTRUCTION PROGRAM USED IN THE PERFORMANCE INSTRUCTION APPARATUS

BACKGROUND OF THE INVENTION

1. Field of the Invention

The present invention relates to a performance instruction apparatus and a performance instruction program used in the performance instruction apparatus which gives a performance instruction by showing a model performance manipulation.

2. Description of the Related Art

Various performance instruction apparatuses have been developed, which give performance instruction by showing a model performance manipulation. For example, Japanese laid-open patent application No. 07-036446 discloses a performance instruction apparatus, which reads out, in accordance with a progress of a music program, image information indicating hand images including finger manipulation data corresponding to the music program and keys to be played to display on its display section a performance instruction image.

Another apparatus has been proposed, which indicates keys to be played in accordance with music data and displays on a goggle type display note symbols, finger manipulation and guidance included in the music data, as disclosed in Japanese laid-open patent application No. 2000-352973. Further, Japanese laid-open patent application No. 2001-2882094 discloses an apparatus which displays on a head mounted display (HMD) keys to be played and finger manipulation and gives an alarm when an eyesight of a player strays from a keyboard.

In the conventional performance instruction apparatuses set forth above, since a photographed image of a model performance manipulation is reflected on a keyboard which a practitioner plays, it is sometimes difficult in bright light to see the image reflected on the keyboard, and further when number of the keys of the keyboard used for indicating the model performance manipulation is different from the keyboard which the practitioner uses, the correct key position is not instructed, which can give confusion to the practitioner.

In a performance instruction apparatus which superimposes a guide image indicating a model performance manipulation on a photographed eyesight image of the practitioner to give a performance instruction, if the guide image is prepared from the photographed model performance manipulation, a large amount of data are required, resulting in unnecessary use of memory and increase of load to be processed by CPU in a computer, and further it will invite a difficulty to distinguish the guide image from the eyesight image.

Further, in a goggle type performance instruction apparatus to be worn by the practitioner, in which the guide image representing the model performance manipulation and the photographed eyesight image of the practitioner are displayed in an overlapping manner, since the eyesight image viewed from a position of the practitioner's eye is used, the practitioner can clearly and definitely learn the position of the key to play and how to manipulate his/her fingers, but he/she can not learn a posture of his/her hand for playing an instrument.

SUMMARY OF THE INVENTION

According one aspect of the present invention, there is provided a performance instruction apparatus which gives a clearly visible performance manipulation instruction, and allows the practitioner to practice playing a keyboard instrument correctly, even though the keyboard instrument used for giving a model performance manipulation is different in number of keys from the keyboard instrument used by the practitioner.

According to another aspect of the invention, there is provided a performance instruction apparatus which is improved so as to rapidly process data, and which allows the practitioner to clearly and easily confirm the guide image and the eyesight image.

According to still another aspect of the invention, there is provided a performance instruction apparatus which allows the practitioner to learn a posture of his/her hand manipulating the keyboard instrument.

According to yet another aspect of the invention, there is provided a performance instruction apparatus which comprises teaching equipment of a goggle type used by a practitioner, a display section provided on the teaching equipment, an image memory for storing a guide image representative of an image of a hand of the practitioner playing an instrument, the guide image including information for indicating a key to be played and for teaching the practitioner how to manipulate his/her fingers, an image pickup section provided on the teaching equipment for taking a picture of at least the keyboard of the musical instrument and the practitioner's hand playing the keyboard to generate an eyesight image corresponding to an eyesight of the practitioner, and an adjusting section for reading out the guide image from the image memory, and for adjusting a size and a position of the read out guide image to be displayed on the display section, and for displaying on the display section the eyesight image generated by the image pickup section and the guide image adjusted in its size and position in a superimposed manner to indicate the key to be played and to teach the practitioner how to manipulate his/her finger to play the key.

With the performance instruction apparatus set forth above, the practitioner can practice playing the musical instrument correctly, even though the musical instrument used for giving the model performance manipulation is different in key position or number of keys from the musical instrument used by the practitioner.

According to other aspect of the invention, there is provided the performance instruction apparatus which further comprises a transforming section for changing number of colors and number of pixels of at least a part of the eyesight image based on the guide image read out from the image memory to generate a transformed eyesight image, and for displaying on the display section the transformed eyesight image and the guide image in a superimposing manner to indicate the key to be played and to teach the practitioner how to manipulate his/her finger to play the key. With the performance instruction apparatus set forth above, it is expected that data are processed rapidly, since number of colors and pixels included in the eyesight image are reduced.

According to yet other aspect of the invention, there is provided the performance instruction apparatus which further comprises an image pickup section for taking from a side a picture of a hand of the practitioner who plays the musical instrument to obtain a side eyesight image, an extracting section for extracting an image of a hand portion of the practitioner from the obtained side eyesight image, and a judging section for judging whether or not the image of the hand portion of the practitioner extracted by the extracting section coincides with a model posture of a hand of a player defined by the judgment data, and for advising the practitioner of the result of judgment.

With the performance instruction apparatus set forth above, the practitioner is advised whether or not his/her hand posture is correct.

BRIEF DESCRIPTION OF THE DRAWINGS

The present invention will be more apparent from the following description, when taken in conjunction with the accompanying drawings, in which;

FIG. 12 is a view showing an example of a judgment MAP.

DETAILED DESCRIPTION OF THE PREFERRED EMBODIMENTS

Now, a performance instruction apparatus according to embodiments of the present invention will be described in detail with reference to the accompanying drawings.

Figure 1:
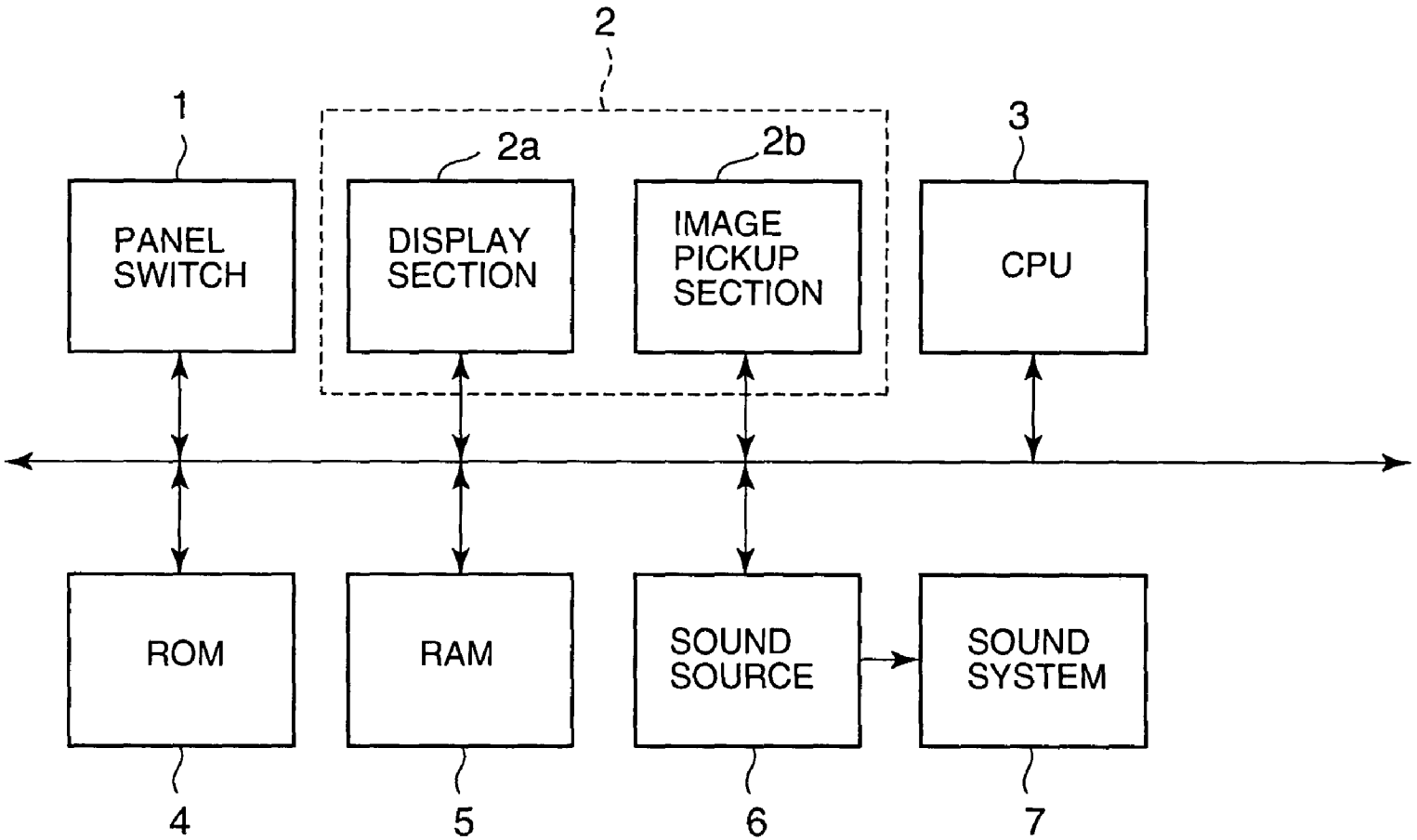
FIG. 1 is a block diagram showing a first embodiment of the present invention.

FIG. 1 is a block diagram illustrating a whole configuration of the performance instruction apparatus according to a first embodiment of the invention. In FIG. 1, a panel switch group 1 includes various switches and outputs a switch event corresponding to an operated switch. More specifically, the panel switch group 1 includes a power switch for power on or power off, a song selecting switch for selecting a song for a performance instruction, and a start/stop switch for instructing start/stop of the performance instruction, etc.

Figure 2A:
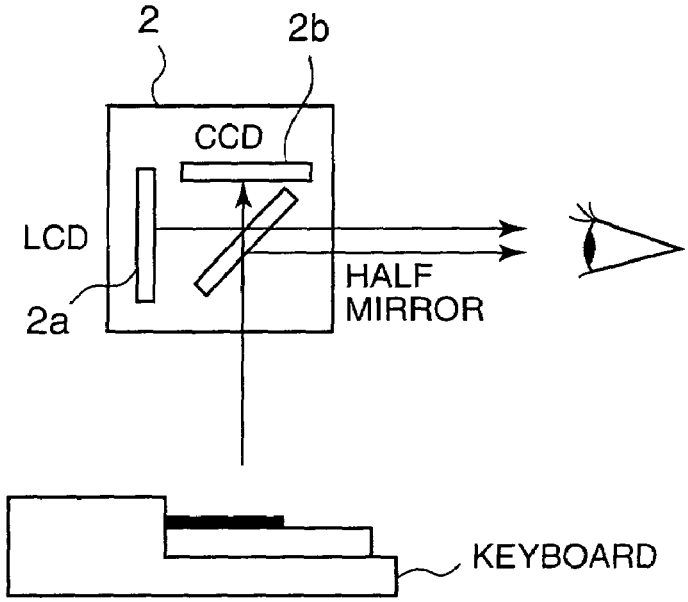
FIGS. 2A and 2*b* are simplified diagrams illustrating a head mounted display.
Figure 2B:
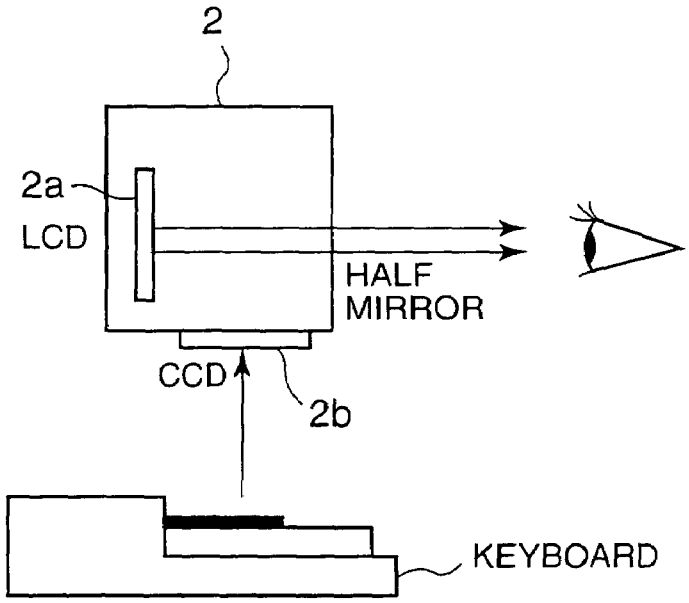

A goggle type of head mounted display (hereafter, HMD) 2 is used by a user or a practitioner who practices a musical instrument, wearing the same on his/her head. As shown by way of example in FIG. 2*a*, HMD 2 is provided with a display section 2*a* comprising LCD panel, etc., an image pickup section 2*b* comprising a CCD camera and its driving circuit, and a half mirror 2*c*.

HMD 2 allows the practitioner who practices the musical instrument to visually confirm through the half mirror 2*c* his/her performance on a keyboard of the musical instrument, and meanwhile takes a picture of an image (eyesight image) representing practitioner's fingers flipping the keyboard with the image pickup section 2*b* and displays on the display section 2*a* a guide image, as will be set forth later, representing model performance in response to the eyesight image taken with the image pickup section 2*b*, wherein the guide image is adjusted in size and its display position by control of CPU 3 so as to be displayed correctively on the display section 2*a*, and whereby the eyesight image of the practitioner and the guide image are displayed in an overlapping fashion, by which the practitioner can learn how to use his/her fingers and confirm keys to flip.

In case that the half mirror 2*c* is not used, HMD2 may be constructed such that the eyesight image which is taken with the image pickup section 2*b* and shows the practitioner's fingers playing the keyboard and the guide image which is adjusted in display size and display position so as to meet the eyesight image are displayed on the display section 2*a* in an overlapping manner, whereby the practitioner can learn how to manipulate his/her fingers and the keys to tap.

CPU 3 serves to control various sections in HMD 2, but the operation related to the features of the present invention will be described later. ROM 4 is provided for storing various control programs to be loaded on CPU 3, and performance data and guide image data obtained with respect to each of songs for performance instruction. The performance data comprises data to be automatically performed in synchronization with the performance instruction, and further includes a pitch of each of sounds consisting a song, and its event timing of sounding and/or sound deadening.

The guide data is prepared for each of sounds consisting a song to display images each indicating a position on the keyboard where a practitioner should place his/her hand and how to manipulate his/her fingers. More specifically, the guide data is prepared for displaying a hand figure at a position on the keyboard where the practitioner should place his/her hand, and for indicating how to manipulate his/her fingers with the hand figure displayed by moving a finger figure. Finger manipulation information included in the guide image data is used to indicate how to manipulate the fingers. The finger manipulation information is for indicating with which right hand finger or left hand finger each key should be played. The guide image data includes position coordinate values for adjusting a display position with respect to the eyesight image taken in with the image pickup section 2*b*.

RAM 5 is used as a work area, including a register area for temporarily storing various resister flag data, an eyesight image data area for temporarily storing eyesight image data taken in with the image pickup section 2*b* of HMD 2, and a guide image data area for temporarily storing the guide image data selected and sent from the ROM 4 by manipulation of the song selecting switch. A sound source 6 is of a so-called memorized waveforms reading out type, and generates a musical signal based on performance data read out from ROM 4 according to the instruction by CPU 3. A sound system 7 converts the musical signal received from the sound source 6 into an analog waveform signal, and outputs the analog signal through a speaker after reducing unnecessary noises.

Now, operation of the first embodiment will be described with reference to FIG. 3 through FIG. 7. At first, operation of a main routine procedure, and then a switching procedure, a guide image reproducing procedure and a performance instruction procedure involved in the main routine procedure will be described separately.

(a) Main Routine Procedure

Figure 3:
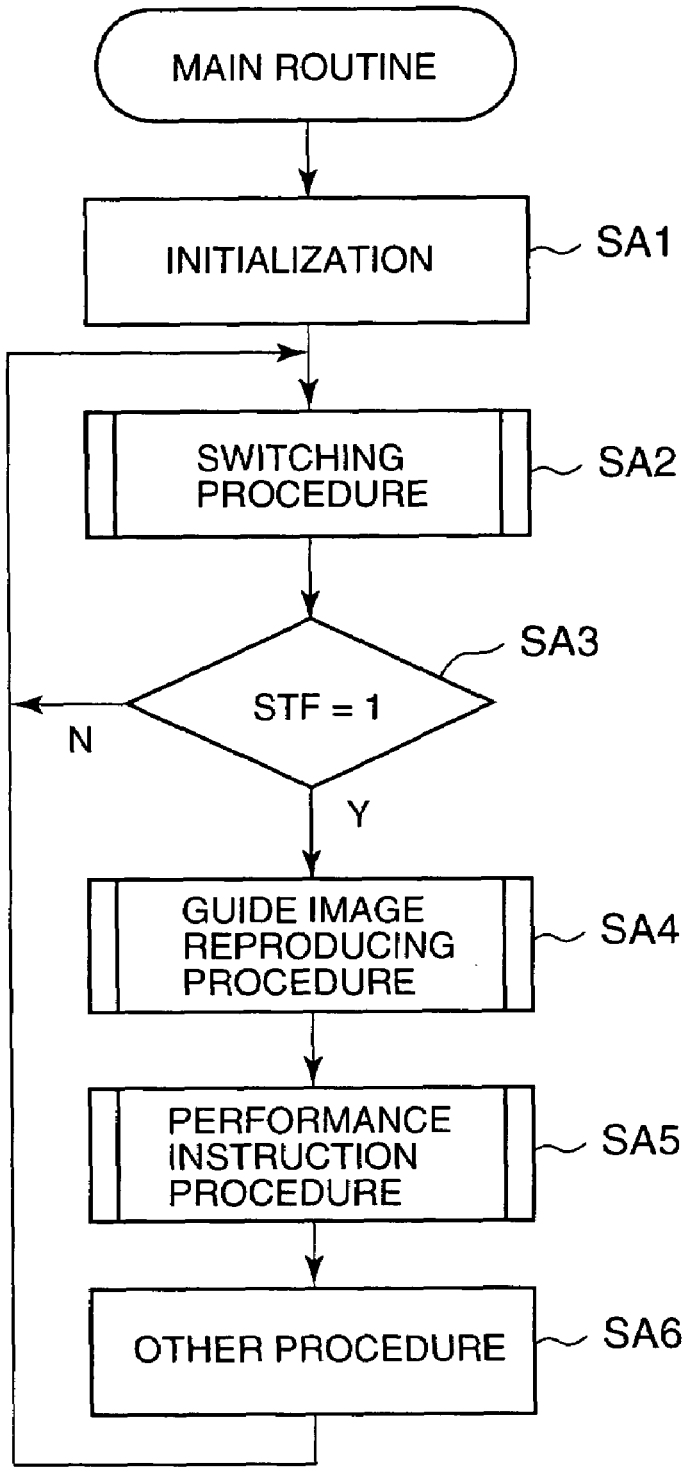
FIG. 3 is a flow chart showing operation of a main routine procedure.

In the first embodiment, when the power is turned on, a control program is loaded from ROM 4 and CPU 3 performs the main routine procedure shown in FIG. 3. At step SA1, various sections in HMD 2 are initialized, and at step SA2, a switching procedures corresponding to manipulation of the switches are performed. In the switching procedure, performance data and guide image data are designated for a song that is selected by manipulation of the song selecting switch, and/or start/stop of the performance instruction is instructed by manipulation of the start/stop switch. Then, it is judged at step SA3 whether or not a flag STF, as will be set forth later, has been set to "1", or if the performance instruction has started.

If the flag STF has been set to "0", the result of judgment is "NO", and the procedure returns to step SA2. If the start/stop switch is manipulated to start the performance instruction, then the flag STF has been set to "1", or the result of judgment at step SA2 will be "YES". The procedure advances to a process at step SA4, in which the guide image reproducing procedure is performed. In the guide image reproducing procedure, the guide image is adjusted in display size and display position to be displayed on the display section 2*a* in accordance with the eyesight image taken in with the image pickup section 2*b* of HMD 2, and the eyesight image and the adjusted guide image are displayed on the display section 2*a* in a superimposed manner. The guide image is prepared to indicate a model instrument playing manipulation.

At step SA5, the performance instruction procedure is performed. In the performance instruction procedure, finger manipulation information is extracted from the eyesight image data picked up with the image pickup section 2*b*, and is compared with the finger manipulation information included in the guide image data to evaluate whether or not the playing manipulation is performed in conformity with the model manipulation. Then, at next step SA6, other procedure is performed. For instance, performance data of a song for the performance instruction is reproduced in synchronization with a preset reproducing tempo. Thereafter, processes at step SA2 through step SA6 are repeatedly performed until the power is turned off or the performance instruction is finished by operation of the start/stop switch.

(b) Operation of Switching Procedure

Figure 4:
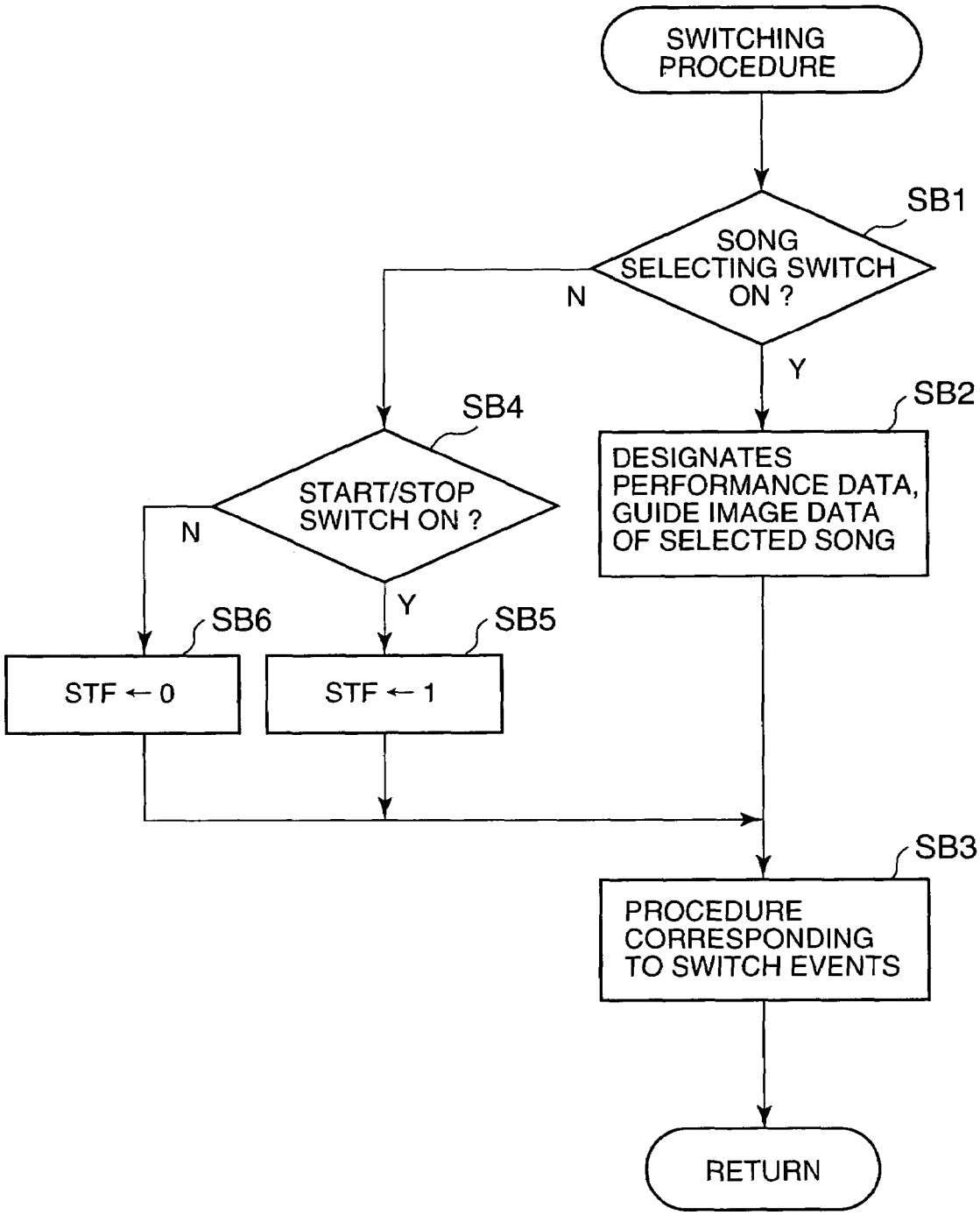
FIG. 4 is a flow chart showing operation of a switching procedure.

The operation of the switching procedure at step SA2 will be described in detail with reference to FIG. 4. In the switching procedure at step SA2, CPU 3 advances to a process at step SB1, where CPU 3 determines whether or not there is an on-event of the song selecting switch, that is CPU 3 judges whether the song selecting switch is manipulated to "ON". When the song selecting switch is manipulated to "ON", that is, the result of judgment is "YES", CPU 3 advances to a process at step SB2, where performance data and guide image data are designated with respect to a song selected by manipulation of the song selecting switch. The designated guide image data is transferred to the guide image data area in RAM 5. Then, procedures corresponding to the other switch events are performed at step SB3, finishing the switching procedure.

Meanwhile, when the song selecting switch is not manipulated, that is, the result of judgment at step SB1 is "NO", CPU 3 advances to a process at step SB 4, where it is judged if the start/stop switch is manipulated to "ON". When the start/stop switch has been manipulated to "ON", the result of judgment will be "YES", and the flag STF is set to "1". Then, CPU 3 advances to a process at step SB3. On the contrary, when the start/stop switch has not been manipulated, the result of judgment will be "NO", and the flag STF is reset. Then, CPU 3 advances to a process at step SB3.

(c) Operation of Guide Image Reproducing Procedure

Figure 5:
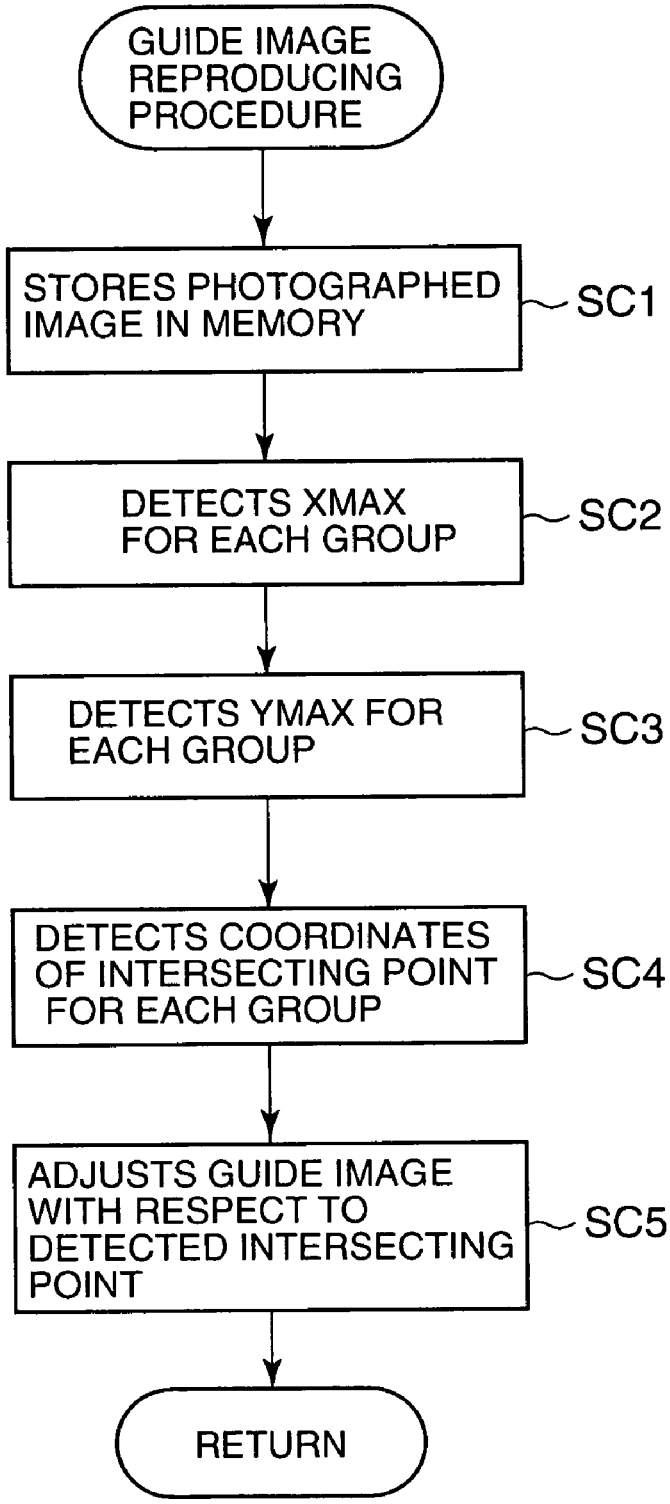
FIG. 5 is a flow chart of operation of a guide image reproducing procedure.
Figure 6:
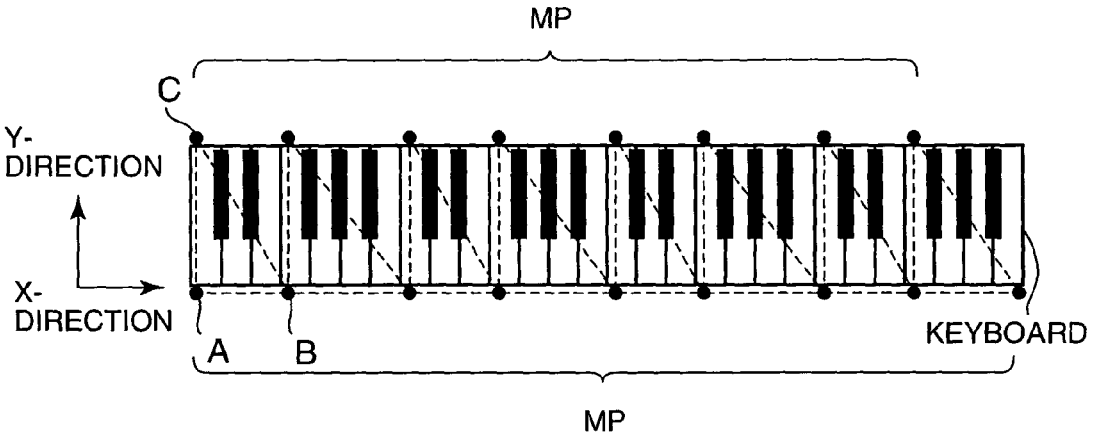
FIG. 6 is a view illustrating marks MP written on a top and lower sides of a keyboard at certain intervals.

Operation of the guide image reproducing procedure will be described with reference to FIG. 5 and FIG. 6. The present procedure is performed at step SA4 in the main routine procedure of FIG. 4. In the guide image reproducing procedure, CPU 3 advances to a process at step SC1 shown in FIG. 5, where the eyesight image data photographed with the image pickup section 2*b* of HMD 2 is sent to and stored in the eyesight image data area. The eyesight image data includes an image which is taken in with the image pickup section 2*b* of HMD 2 with its image-pickup sight kept toward the keyboard, and it is assumed that marks MP are written at certain intervals on the upper side and the lower side (as viewed in the drawing) of the keyboard involved in the image, that is, the keyboard that the practitioner plays.

At step SC2 through step SC4, assuming that there are plural groups each consisting of a triangle area defined by straight lines each connecting two of three imaginary coordinates A, B, and C on the keyboard respectively corresponding to the marks MP in the obtained eyesight image data (Refer to FIG. 6), CPU 3 detects for each group the longest line segment Xmax in the X-axis direction, and the longest line segment Ymax in the Y-axis direction, and coordinates of an intersecting point of these line segments Xmax and Ymax. Then, at step SC5, the guide image data is adjusted in its size and display position so that the position coordinates included in the guide image data will coincide with the detected coordinates of the intersecting point for each group. The guide image superimposed on the eyesight image of the practitioner is displayed on the display section 2*a* of HMD 2, which will give the practitioner clear performance instruction.

(d) Operation of Performance Instruction Procedure

Figure 7:
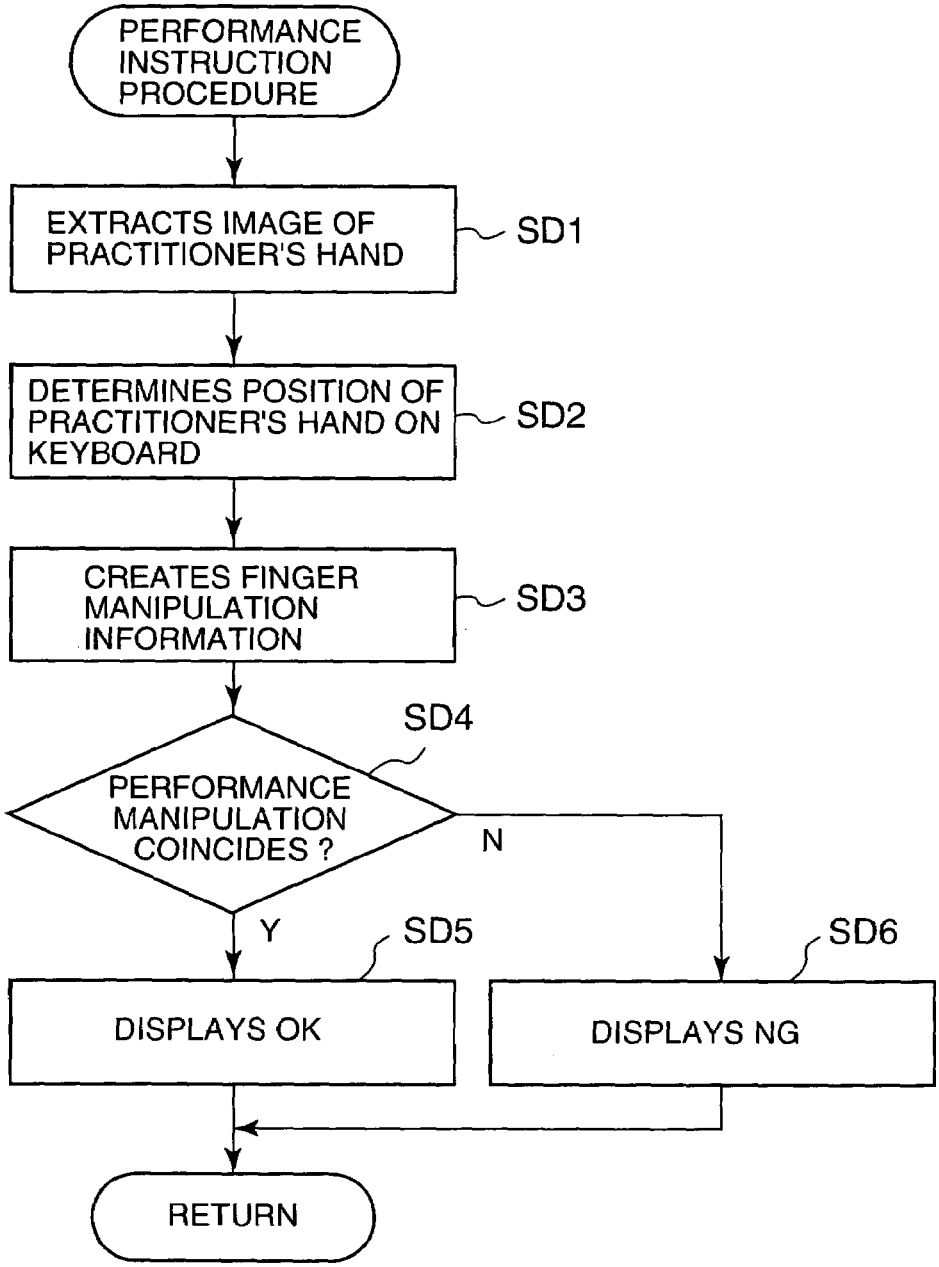
FIG. 7 is a flow chart showing operation of a performance instruction procedure.

Now, the operation of the performance instruction procedure will be described with reference to FIG. 7. When the performance instruction procedure is performed at step SA5 in the main routine procedure, CPU 3 advances to a process at step SD1. At step SD1, the eyesight image stored in the eyesight image data area of RAM 5 is subjected to an image recognizing procedure, whereby a hand figure of the practitioner is extracted, and then it is judged at step SD2 where (key position) the extracted hand figure is placed on the keyboard. More specifically, it is determined with reference to the marks MP previously written on the upper and lower side of the keyboard at a certain intervals, where (key position) the extracted hand figure is placed on the keyboard.

At step SD3, the image recognizing procedure detects a finger playing the key based on the determined key position to create the finger manipulation information of the practitioner. At step SD4, CPU 3 compares the finger manipulation information of the practitioner with the corresponding finger manipulation information included in the guide image data to determine whether or not the performance has been performed as instructed.

When the performance has been performed as instructed, the result of judgment will be "YES", and the procedure advances to step SD5, where an indication of "OK" is displayed on the display section 21 of HMD 2, representing that the performance has been performed correctly as instructed. On the contrary, when the performance has not been performed as instructed, the result of judgment will be "NO", and the procedure advances to step SD6, where an indication of "OK" is displayed on the display section 21 of HMD 2, and the current procedure terminates.

In the first embodiment, when the practitioner wearing the goggle type HMD 2 begins performance practice, he/she can confirm on the display section 2*a* of HMD 2 the guide image representing the model performance superimposed on his/her own eyesight image, which allows the practitioner to receive the performance instruction with clear visibility.

In the present embodiment, the marks MP are written on the upper and lower side of the keyboard that he/she plays, and these marks are used to superimpose the guide image on the eyesight image of the practitioner, or to determine on which key position included in the eyesight image his/her hand is placed. It will be possible without using these marks MP, for instance, to detect the black keys of the keyboard in the eyesight image and to superimpose the the guide image on the eyesight image of the practitioner using the detected black keys, or to determine on which key position the practitioner places his/her hand by considering the regularity of arrangement of the detected black keys.

Now, modifications to the first embodiment will be described with reference to FIG. 8 and FIG. 9. In the guide image reproducing procedure of the first embodiment, assuming that each group includes the triangle area defined by straight lines each connecting two of three imaginary coordinates A, B, and C (refer to FIG. 6) corresponding to the marks MP in the eyesight image data obtained by the image pickup section 2*a*, CPU 3 detects for each group the longest line segment Xmax in the X-axis direction, and the longest line segment Ymax in the Y-axis direction, and coordinates of an intersecting point of these line segments Xmax and Ymax, and then adjusts the size and display position of the guide image data so as to make the position coordinates included in the guide image data coincide with the detected coordinates of the intersecting point for each group, whereby the guide image is superimposed on the eyesight image of the practitioner on the display section 2*a* of HMD 2.

However, the above procedure results in increasing calculation load to be processed by CPU 3. Therefore, when the practitioner intentionally transfers his/her gaze from the keyboard, CPU 3 performs the calculation process in response to the practitioner's intention, which can invite delay in display of the guide image. In the modification to the first embodiment, the guide image reproducing procedure for superimposing the guide image on the eyesight image solves the above drawbacks, which will be described hereafter.

When the process at step SA4 of the main routine procedure (FIG. 3) is performed in the similar manner as in the above first embodiment, CPU 3 performs a process at step SE1, where an average H of differences between the intersecting positions previously detected for each group and intersecting positions newly detected for each group is calculated. In this case, assuming that there are plural imaginary groups on the keyboard, each group including the triangle area defined by straight lines each connecting two of three imaginary coordinates A, B, and C (refer to FIG. 9) corresponding to the marks MP in the eyesight image data obtained by the image pickup section 2*a*, the intersecting position means the intersecting point of the longest line segment Xmax in the X-axis direction and the longest line segment Ymax in the Y-axis direction for each group. Then, it is judged at step SE2, if the calculated average H exceeds 4 times of an average distance D, where the average distance D is an average of distances between the intersecting points previously detected for each group.

When the average H exceeds 4 times of the average distance D, the judgment result at step SE2 is "YES". In this case, it is presumed that the practitioner has intentionally transferred his/her gaze from the keyboard, and the present procedure terminates.

Figure 9A:
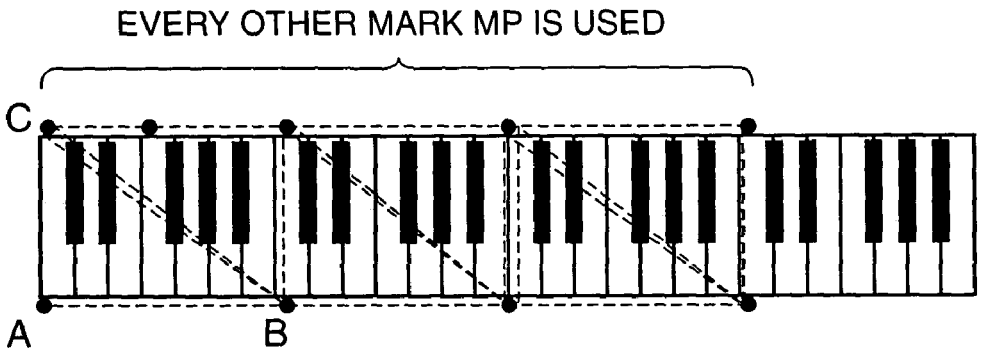
FIGS. 9*a*, 9*b*, and 9*c* are views each showing the operation of the guide image reproducing procedure in the modified first embodiment.

On the contrary, when the average H does not exceed 4 times of the average distance D, the judgment result at step SE2 is "NO", and the procedure advances to step SE3, where it is determined whether or not the calculated average H exceeds twice the average distance D. When the calculated average H exceeds twice the average distance D, the judgment result at step SE3 is "YES", and the procedure advances to step SE4, where the procedure is set such that every other mark MP in the obtained eyesight image data is used as shown in FIG. 9*a*. In other words, number of marks MP that are used for detecting the intersecting coordinate is reduced by half.

Figure 9B:
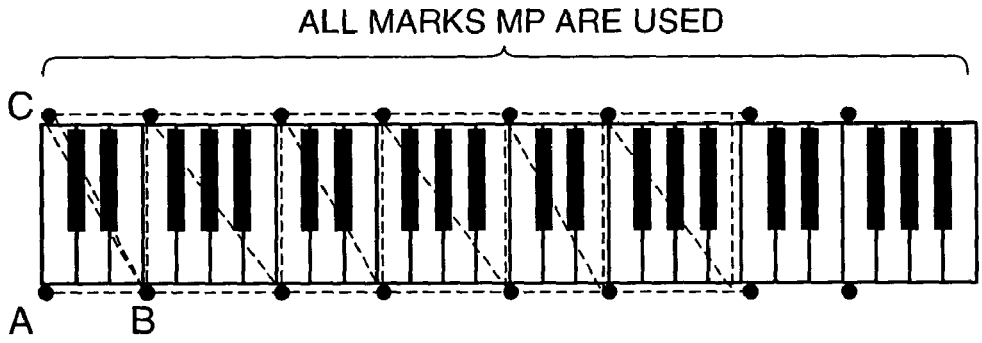

Meanwhile, when the calculated average H does not exceed twice the average distance D, the judgment result at step SE3 is "NO", and the procedure advances to step SE5, where the procedure is set such that all of the marks MP in the obtained eyesight image data are used as shown in FIG. 9*b*. At step SE6, data set in the basic unit of the triangle defined by lines connecting the coordinates A, B, and C are created using the marks MP which are set to be used, as shown in FIG. 9A or FIG. 9*b*. Then, at step SE7, the position coordinates are extracted from the guide image data respectively corresponding to the data set created from the marks MP, and the coordinates are converted such that the triangle defined by the extracted position coordinates will coincide with a triangle defined by the corresponding data set.

Figure 9C:
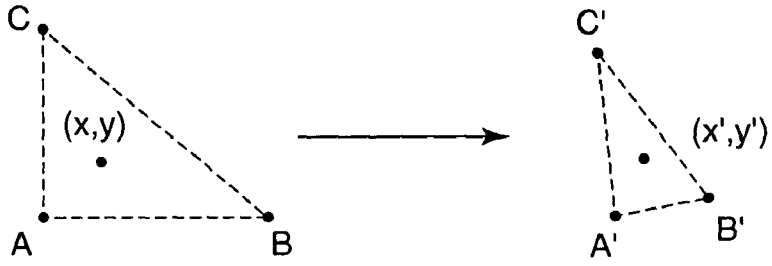

More specifically, the coordinates are converted as shown in FIG. 9*c* such that a triangle ABC defined by the position coordinates extracted from the guide image data will coincide with a triangle A'B'C' defined by the marks MP. At step SE8, it is judged if the coordinates have been converted. When the coordinates have not been converted, the judgment result at step SE8 is "NO", and the procedure returns to step SE7. When the coordinates have been converted, the judgment result at step SE8 is "YES", and the procedure terminates. In the present procedure, the display size and the display position of the guide image data are adjusted, and the guide image data is displayed in a superimposed manner on the eyesight image of the practitioner.

As described above, according to the modification to the first embodiment, if either the eyesight image of the practitioner or the guide image exceeds a predetermined value, it is presumed that the practitioner has intentionally transferred his/her gaze from the keyboard, and the guide image data is not reproduced. When either the eyesight image of the practitioner or the guide image does not exceed a predetermined value, the resolution at which the display size and the display position of the guide image data are arranged to the eyesight image of the practitioner is adjusted depending on the difference. Therefore, the guide image can be superimposed on the eyesight image of the practitioner without imposing the increased calculation load onto CPU 3.

In the above first embodiment, the practitioner wears HMD 2, and this HMD 2 displays on the display section 2*a* the guide image representing the model performance in a superimposed manner on the eyesight image of the practitioner, whereby the practitioner is allowed to follow the performance instruction with the clear visibility. In a second embodiment, even though the keyboard for giving the model performance instruction is different in number of keys from the keyboard which the practitioner uses for practice, the practitioner can receive correct performance instruction.

The second embodiment of the invention has the same construction as the first embodiment and therefore the description thereof will be omitted. In the second embodiment, the number of keys included in the keyboard for practice is detected from the eyesight image data, and the guide image is reproduced based on the guide image data corresponding to the detected key number. A guide image reproducing procedure in the second embodiment will be described with reference to FIG. 10 through FIG. 12.

Figure 8:
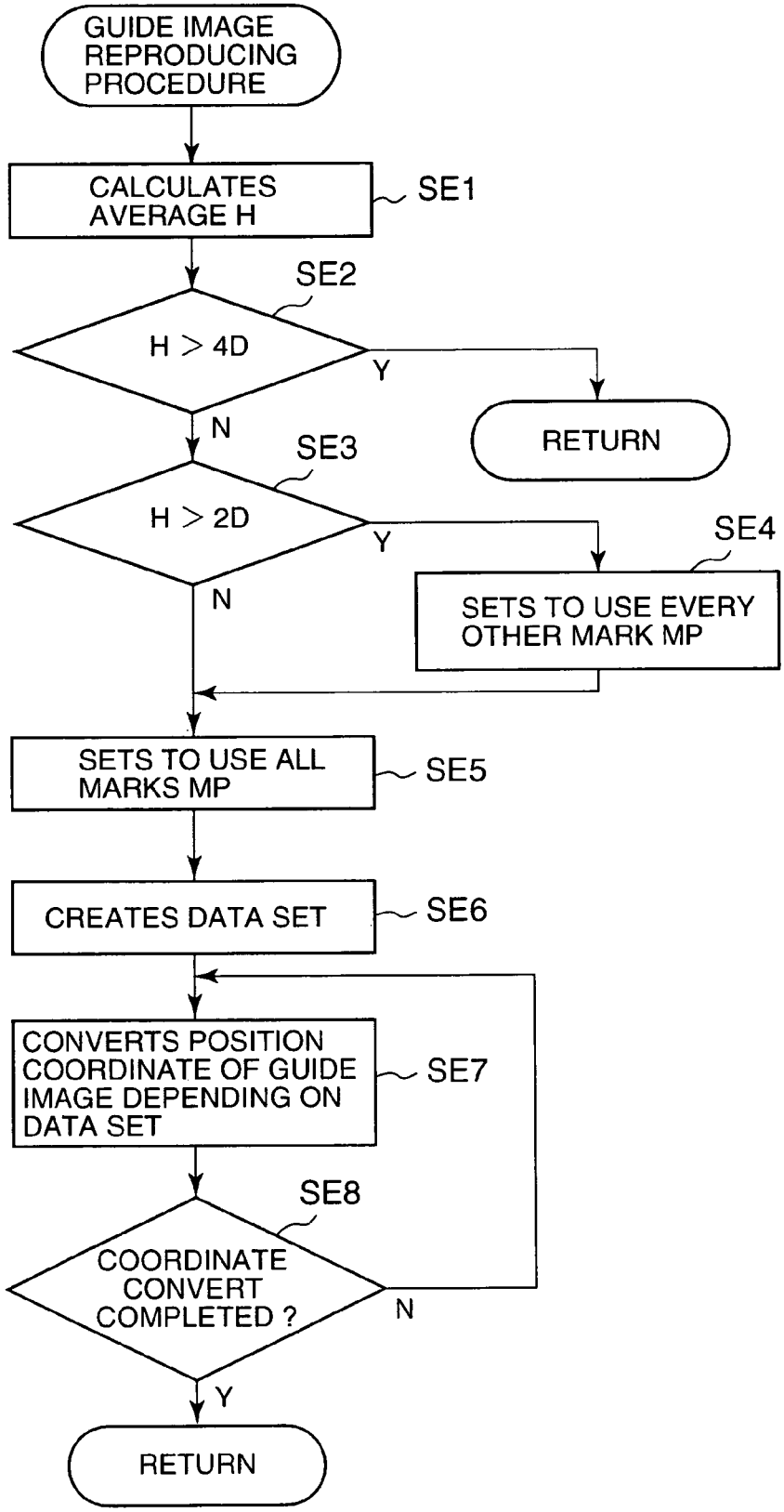
FIG. 8 is a flow chart showing operation of a guide image reproducing procedure in a modified first embodiment.

In the second embodiment, when the guide image reproducing procedure is performed at step SA4 in the main routine operation (FIG. 3) in the same manner as described above in the first embodiment, CPU 3 advances to a process at SF1 of FIG. 8, where a key-number detecting procedure is performed to detect from the eyesight image data number of the keys included in the keyboard used for practice.

Figure 11:
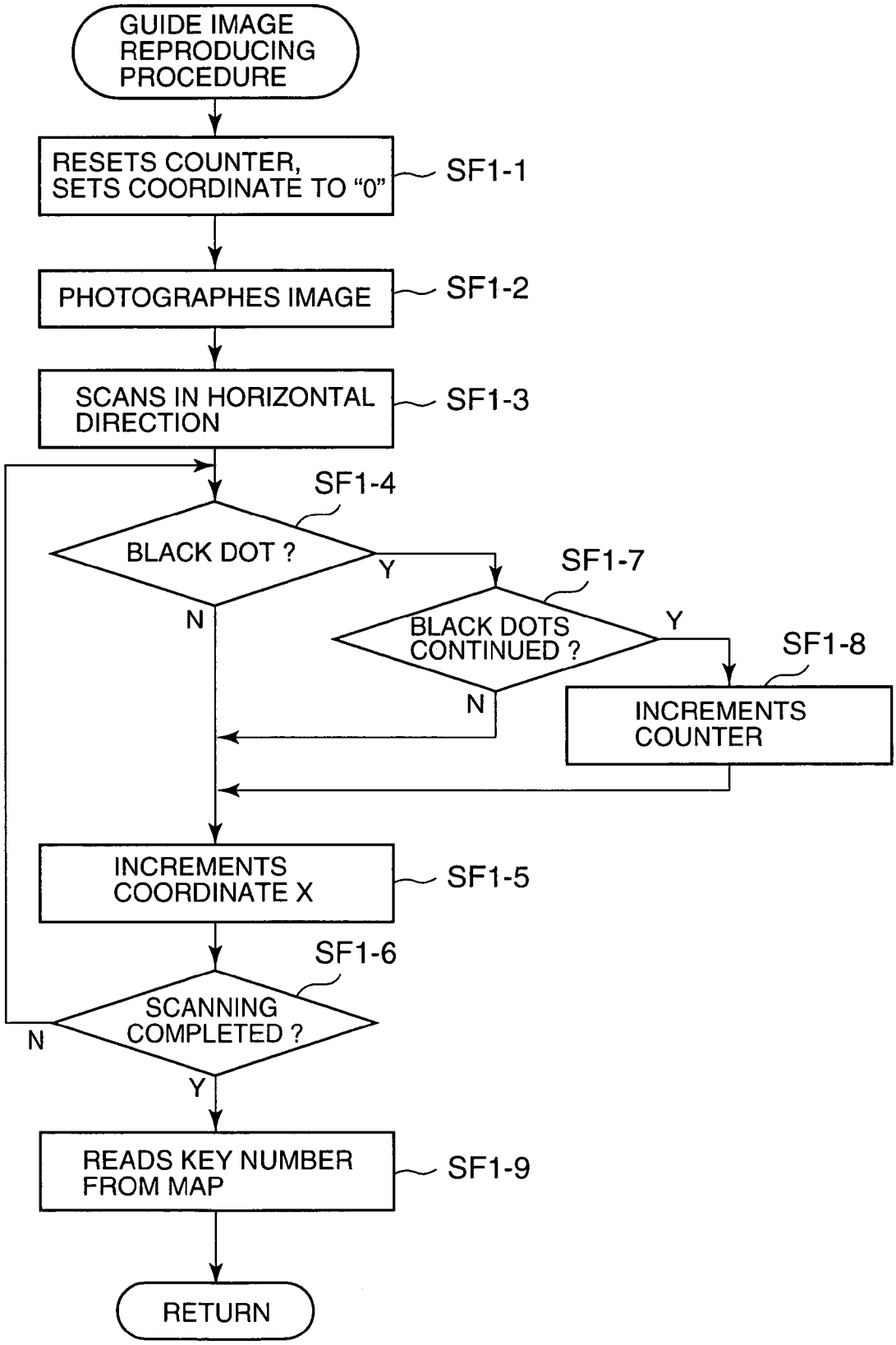
FIG. 11 is a flow chart of operation of a key number detecting procedure in the second embodiment.

When the key-number detecting procedure is performed at step SF1, CPU 3 advances to a process at step SF1-1 of FIG. 11, where a counter for counting the number of black keys included in the keyboard for practice is reset and a detection coordinate X is reset to "0". At step SF1-2, the eyesight image data obtained with the image pickup section 2*b* of HMD 2 is stored in the eyesight image data area of RAM 5, where the eyesight image data is an image picked up or photographed by the image pickup section 2*b* of HMD 2 with the eyesight of the practitioner directed toward the keyboard for practice.

At step SF1-3, the eyesight image data stored in the eyesight image data area of RAM 5 is subjected to a dot scanning process, whereby pixel dots in a certain line in the horizontal direction (X-direction) are sequentially read out, where the certain line is a line in the eyesight image data which runs across the black keys. Then, it is judged at step SF1-4 whether or not the read out pixel dots are those corresponding to the black keys. When the pixel dots correspond to while keys, the result of judgment is "NO", and CPU 3 advances to a process at step SF1-5, where the detection coordinate X is incremented. At step SF1-6, it is judged whether or not the detection coordinate X has reached the extremity, or it is judged whether or no the dot scanning process has been finished. When finished, the judgment result is "NO" and the procedure advances to a process at step SF1-4.

When the pixel dots which are read out as the direction coordinate X is incremented are black dots corresponding to the black keys, the judgment result at step SF1-4 is "YES" and the procedure advances to a process at step SF1-7, where it is judged whether or not the black dots are continuously read out. When the black dots are not continuously read out, it is determined that the black key has not been detected, the judgment result at step SF1-4 is "NO" and the procedure advances to a process at step SF1-5, where the detection coordinate X is incremented. Meanwhile, when the black dots are continuously read out, it is determined that the black key has been detected, the judgment result at step SF1-7 is "YES" and the procedure advances to a process at step SF1-8, where the counter for counting the black keys is incremented and the procedure advances to a process at step SF1-5.

When the dot scanning process for counting the number of black keys has been completed, the judgment result at step SF1-6 is "YES" and the procedure advances to a process at step SF1-9, where a key number is read out from a judgment map MAP in accordance with the detected number of black keys stored in the counter. The judgment map MAP is a data table including attributes of groups of the black keys (pitch, lowest frequency, lowest note-number, number of the black keys and the white keys), as shown in FIG. 12, and the key number is read out from the judgment map using the detected number of the black keys as a read address.

Figure 10:
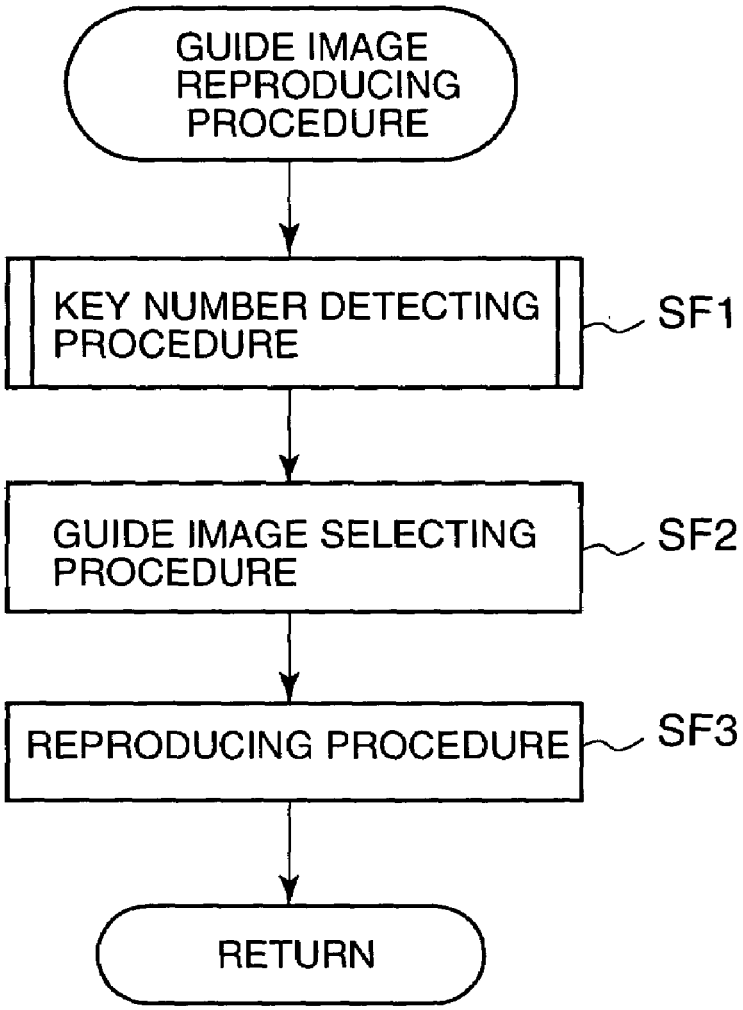
FIG. 10 is a flow chart showing operation of a guide image reproducing procedure in a second embodiment.

When number of the keys included in keyboard is determined based on the detected number of the black keys, CPU 3 advances to a process at step SF2 of FIG. 10, where a guide image selecting procedure is performed to select and read out from ROM 4 guide image data corresponding to the detected number of the keys. At step SF3, a reproducing procedure is performed to adjust the display size and the display position of the selected guide image data so as to display the guide image on the display section 2*a* of HMD 2 in a superimposed manner on the eyesight image of the practitioner. The present reproducing procedure is performed in the same manner as described in the guide image reproducing procedure in the first embodiment (FIG. 5). As described above in the second embodiment, the number of the keys included in the keyboard for practice is detected from the eyesight image data, and the guide image data for the keyboard having the same number of the keys as the detected key number is selected, and the selected guide image data is reproduced for performance instruction. Therefore, even if the number of the keys of the keyboard for performance instruction is not the same as the number of the keys of the keyboard for practice, the practitioner is allowed to correctly receive the performance instruction.

In the second embodiment, the number of the black keys is detected from the eyesight image data including the keyboard and the number of the keys included in the keyboard is calculated using the detected number of the black keys, but using the number of the white keys in place of the number of the black keys, the number of the keys included in the keyboard may be calculated.

It may be also possible to estimate the number of the keys of the keyboard from the eyesight image data using the ratio of a length of the keyboard image in the crosswise direction to a length of the keyboard image in the lengthwise direction. More specifically, if the ratio in size is about 8:9, it may be estimated that the keyboard has 88 keys. If the ratio in size is about 7:7, the keyboard is estimated to have 76 keys. If the ratio in size is about 7:3, the keyboard is estimated to have 73 keys. If the ratio in size is about 6:1, the keyboard is estimated to have 61 keys, and further, if the ratio in size is about 4:9, the keyboard is estimated to have 49 keys. As described above, the number of keys of the keyboard may be estimated from the ratio in size of the keyboard.

In addition, there are another methods of estimating the number of the keys of the keyboard. That is, an area of the keyboard occupied by the white keys and that by the black keys are calculated using the eyesight image data and the number of the keys may be obtained from the ratio of these two areas, or a characteristic parameter is extracted from an arrangement unique to the keyboard and the number of the keys may be obtained from the extracted characteristic parameter.

Further, the practitioner plays a key of the keyboard and a pitch of the generated sound is detected to determine which key is played by the practitioner. Then, a position of the determined key is confirmed on the obtained eyesight image data, and the number of the keys may be calculated using the confirmed position of the determined key and the pitch of the played key.

In the first and second embodiments described above, the eyesight image photographed with the image pickup section 2*b* of HMD 2 is displayed without any modification thereto on the display section 2*a* in a superimposed manner on the guide image representing the model performance manipulation. On the contrary in a third embodiment of the invention as will be described hereafter, image pixels and number of colors of at least a part of the eyesight image are changed to improve a data processing speed.

In the third embodiment, description of like elements as those in the first embodiment will not be omitted. An eyesight image modifying procedure is newly employed in the third embodiment to number of the pixels and colors involved in the photographed eyesight image. This eyesight image modifying procedure is not used in the first and second embodiments. Now, the third embodiment will be described hereafter with reference to FIG. 13 and FIG. 14.

Figure 13:
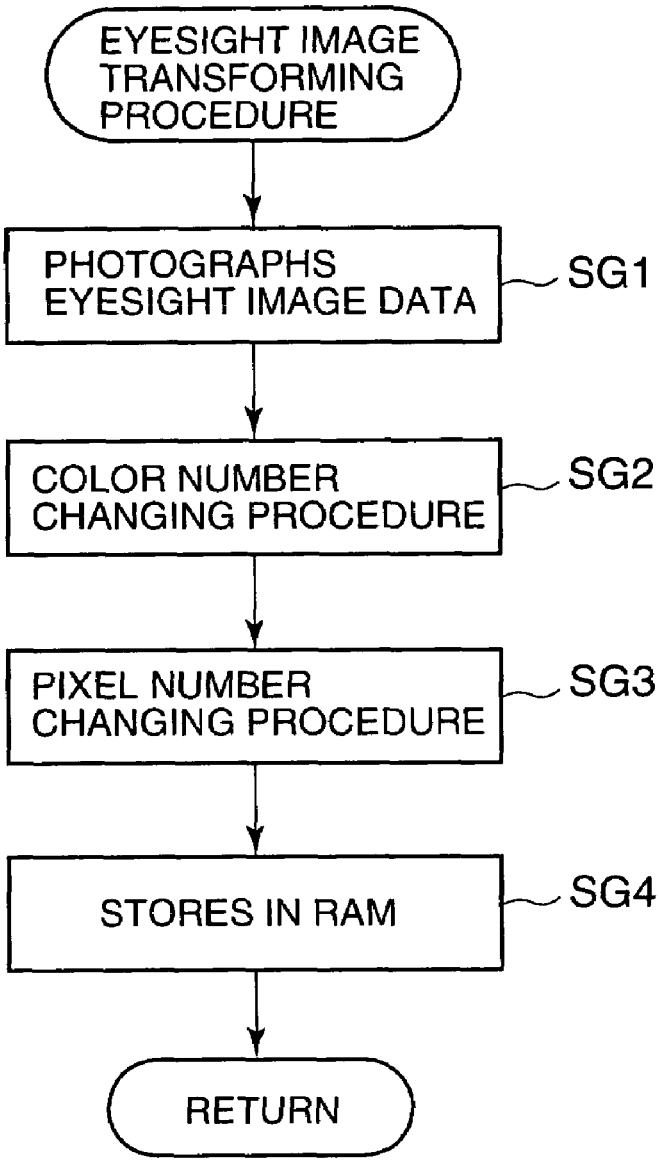
FIG. 13 is a flow chart showing operation of an eyesight image transforming procedure.

FIG. 13 is a flow chart showing operation of the eyesight image transforming procedure. When the process is performed at step SC1 of the guide image reproducing procedure (FIG. 5), CPU 3 advances to a process at step SG1 of FIG. 13, where the eyesight image data photographed with the image pickup section 2*b* of HMD 2 is stored in the eyesight image data area of RAM 5. At step SG2, a color number changing procedure is performed to increase or decrease number of colors involved in the eyesight image data stored in RAM 5 so as to conform to number of colors involved in the guide image data or an animation image. For example, when the guide image is of 16 gradations of color and the eyesight image is of 256 gradations of color, only the high four digits of color information of the eyesight image data will be made effective. At step SG3, a pixel number changing procedure is performed to increase or decrease number of pixels involved in the eyesight image data stored in RAM 5 so as to conform to number of pixels involved in the guide image data or an animation image.

For example, if a ratio of number of pixels involved in the eyesight image data to number of pixels involved in the guide image data is 9 to 1, a 3×3 dot area of the eyesight image data is processed as a one dot area. At step SG4, the eyesight image data processed as set forth above, or the data having the number of colors and the number of pixels is stored in the eyesight image data area of RAM 5.

Figure 14:
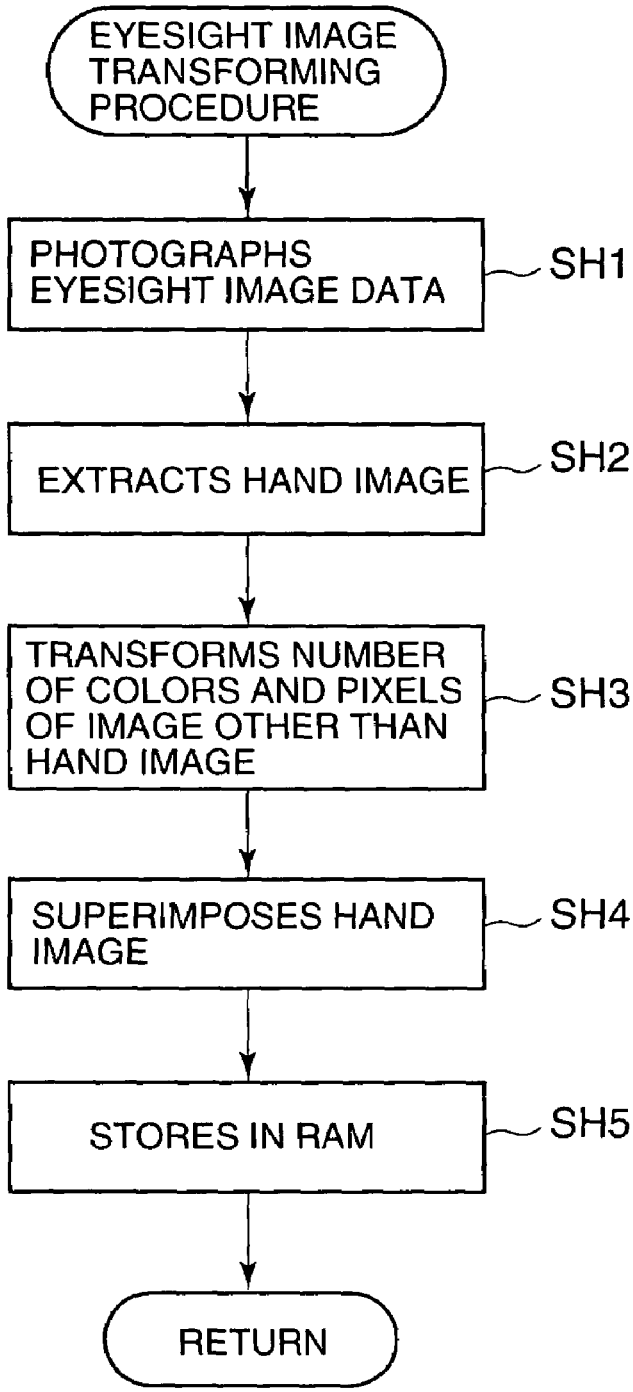
FIG. 14 is a flow chart showing operation of another eyesight image transforming procedure.

In the embodiment described above, the resolution and number of colors of the eyesight image are arranged so as to conform to those of the animation image or the guide image, allowing the user to clearly view the guide image and eyesight image. Without limiting to the above process, another modification or an eyesight image transforming procedure will be useful, as shown in FIG. 14. In the eyesight image transforming procedure, only an image portion representing a hand of the practitioner included in the photographed eyesight image may be modified in resolution and number of colors.

At step SH1 of FIG. 14, the eyesight image data photographed with the image pickup section 2*b* of HMD 2 is stored in the eyesight image data area of RAM 5, and at step SH2, the eyesight image data stored in RAM 5 is subjected to an image recognizing procedure to extract an image of a hand portion of the practitioner. At step SH3, the extracted image displaying the practitioner's hand is subjected to a resolution and color number changing procedure to its resolution and number of colors involved therein so as to conform to those of the guide image. At step SH4, thus processed image displaying the practitioner's hand is superimposed on the eyesight image excluding the image extracted at step SH2, and the resulting image is stored in RAM 5 at step SH5.

As described above, even when the resolution and number of colors of the image representing the hand portion of the practitioner are transformed so as to conform to those of the guide image, the practitioner can view the guide image and the eyesight image.

The resolution of the image representing the keyboard in place of the practitioner's hand and number of colors included therein may be transformed and the similar advantage may be obtained. Further, the image representing the practitioner's hand may be modified so as to be displayed in mono color to reduce data volume.

It may be possible to change the resolution and number of colors of the eyesight image depending on contents of the performance instruction. In other words, when a performance instruction is given for difficult finger manipulation, the eyesight image is displayed with no modification made to the resolution and number of colors, and when a performance instruction is given for easy finger manipulation, the eyesight image is displayed with reduced resolution and less number of colors. With the eyesight image displayed in the above way, the practitioner is allowed to practice fine finger manipulation, and to learn whether or not the performance instruction is difficult.

In the third embodiment described above, the photographed eyesight image are arranged in resolution and number of colors so as to conform to the guide image, but the guide image may be subjected to the modifying procedure. For example, when a hand image of the practitioner in the eyesight image and a hand image in the performance instruction overlap with each other, if an area of the overlapping image is displayed in other color, or displayed in a flashing manner, then the practitioner is allow to learn how his/her finger overlaps with the model finger manipulation.

In the first, second and third embodiments described above, the eyesight image photographed with the image pickup section 2*b* of HMD 2 of a goggle type is displayed on the display section 2*a* in a superimposed manner on the guide image showing the model performance manipulation. In a fourth embodiment, a side image pickup section is employed to take a picture of the hand of the practitioner from the side to create a side eyesight image. The side eyesight image is used for the practitioner to learn or confirm posture of his/her hand including a position of his/her wrist and figure of his/her hand. In the fourth embodiment, description of like elements as those in the embodiments described above will be omitted. Now, the fourth embodiment will be described hereafter with reference to FIG. 15 through FIG. 25.

Figure 15:
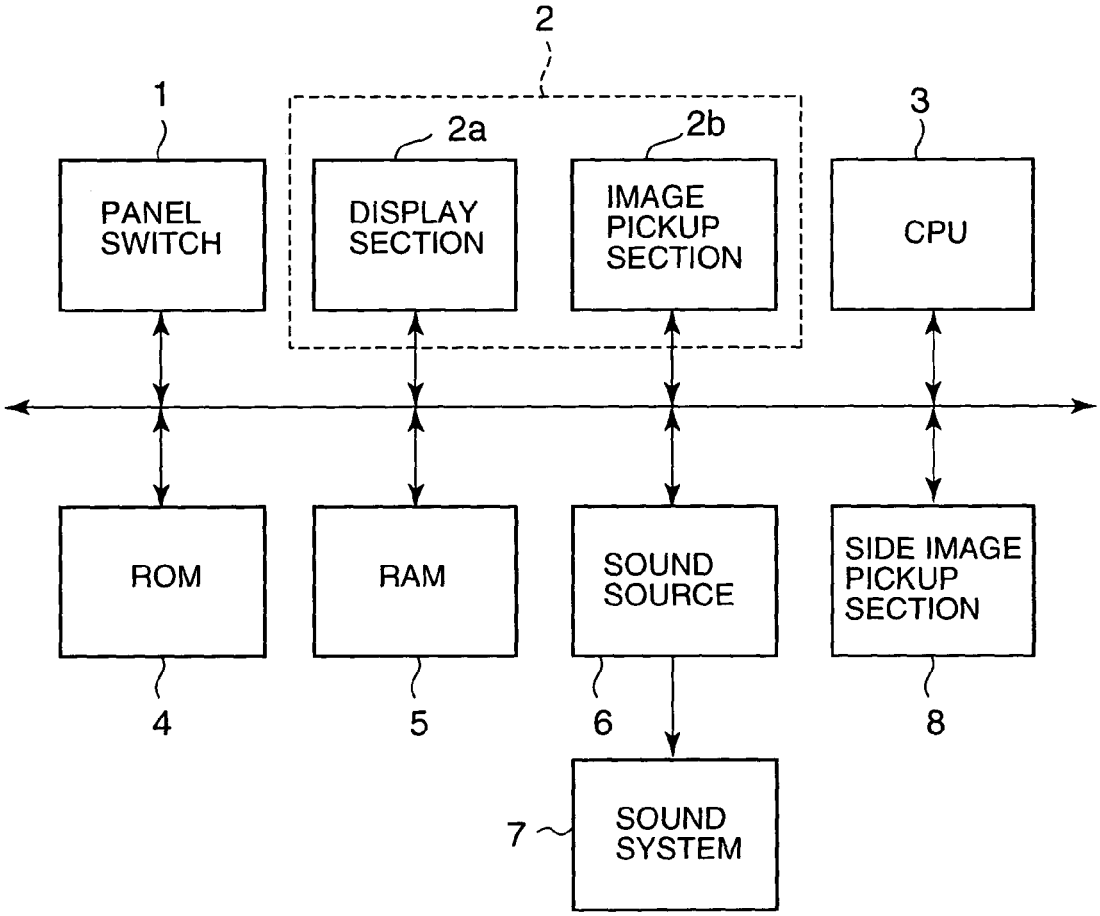
FIG. 15 is a block diagram illustrating a configuration of a performance instruction apparatus according to one embodiment.
Figure 16:
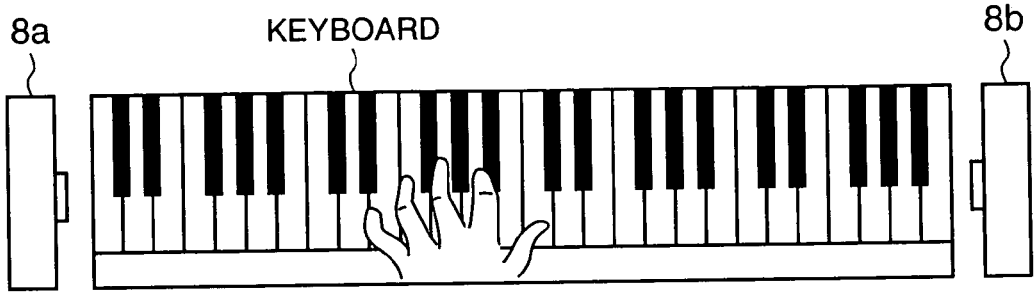
FIG. 16 is a view showing positions where a side image pickup sections are installed.

FIG. 15 is a block diagram illustrating a whole configuration of a performance instruction apparatus according to the fourth embodiment of the invention. The side image pickup section 8 is newly added to the configuration shown in FIG. 1. As shown in FIG. 16, the side image pickup section 8 comprises a CCD camera 8*a* provided on the left side of the keyboard and a CCD camera 8*b* provided on the right side of the keyboard. A picture of the keyboard manipulation by the left hand and a picture of the keyboard manipulation by the right hand are taken with the CCD camera 8*a* and the CCD camera 8*b*, respectively. ROM 4 is prepared for storing various control programs for CPU 3, performance data PD for each song for practice, judgment data HD associated with the performance data PD for judging whether or not the practitioner has played the keys correctly, or whether or not the posture of the practitioner's hand is correct, and the guide image data GD.

Figure 17A:
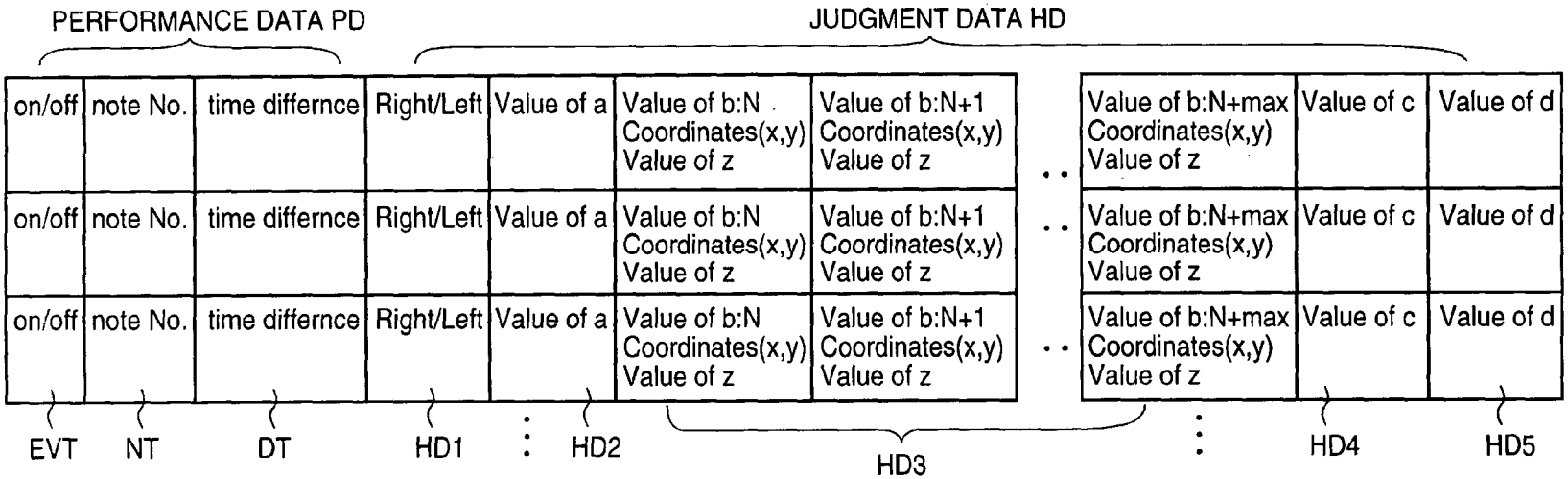
FIG. 17*a* is a view illustrating a configuration of performance data PD and judgment data HD stored in ROM 5.

The performance data PD stored in ROM 4 is data that is automatically played in synchronization with the performance instruction. This performance data PD includes events EVT indicating sound on/sound off, note numbers NT each indicating a pitch, and time differences DT each indicating a time interval between the events, as shown in FIG. 17*a*.

Figure 17B:
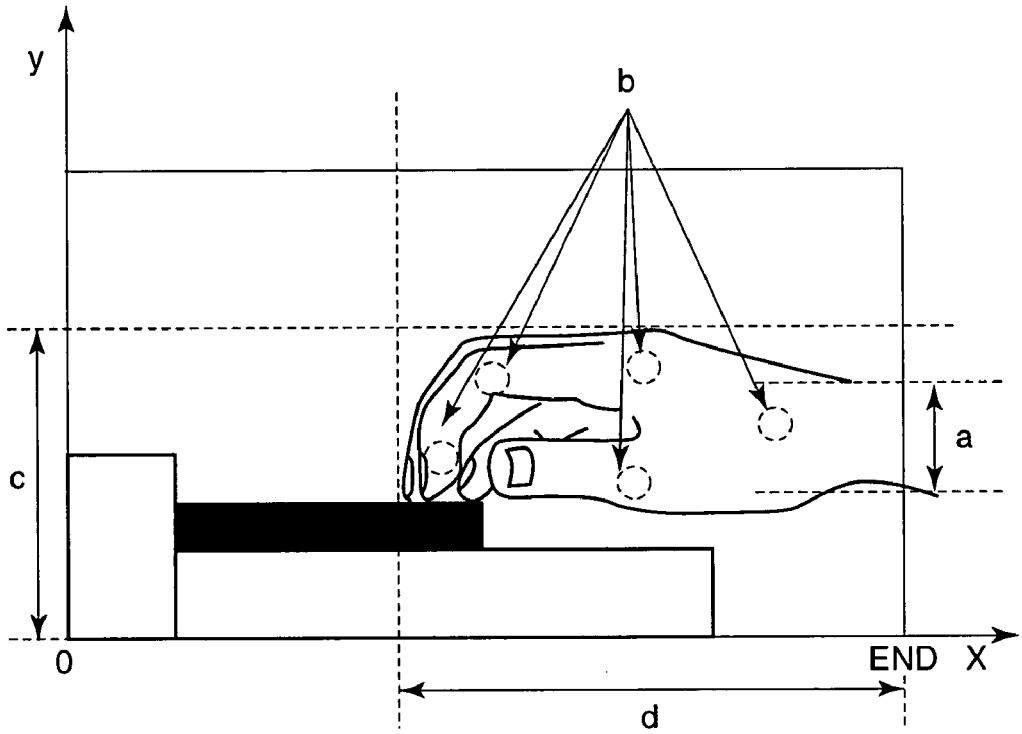
FIG. 17*b* is a view showing an example of a side eyesight image for detecting a position of a hand on a keyboard.
Figure 18:
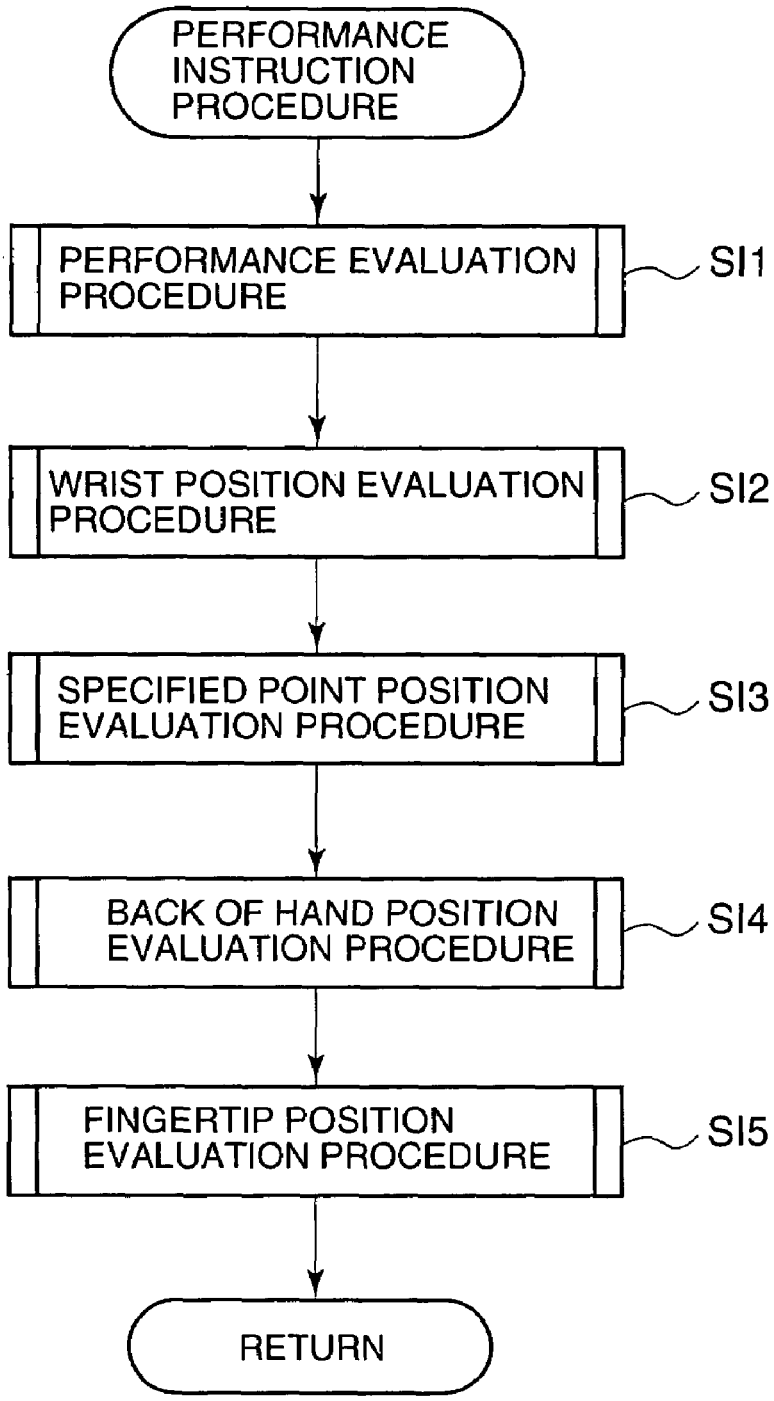
FIG. 18 is a flow chart showing operation of a performance instruction procedure.

Judgment data HD prepared for each event EVT included in the performance data PD includes data HD1 through HD5. Data HD1 is a flag for judging which data should be refered, side eyesight image data from the CCD camera 8*a* or from the CCD camera 8*b*. Data HD2 through HD4 are used to determine whether or not the practitioner has correctly placed his/her hand on the keyboard. Data HD2 is used for detecting a position of the wrist (FIG. 17*b*, a). Data HD3 is used to judge at plural points (FIG. 17*b, b*) whether or not the hand has been placed correctly. Data HD4 is used to detecting a position of back of the hand (FIG. 17*b, c*). Data HD5 is used for detecting a position of fingertips (FIG. 17*b, d*).

The guide image data GD is prepared for each of sounds composing a song, and for displaying an animation image representing a position on the keyboard where the practitioner should placed his/her hand, and how the practitioner should manipulate his/her fingers. More specifically, the guide image displays a hand figure at a position on the keyboard where the hand should be placed and how the fingers should be manipulated on the keyboard to play the key. The finger manipulation information included in the guide image data is used to display how the fingers should be manipulated on the keyboard. The finger manipulation information indicates with which finger (of his/her right or left hand) a certain key should be played. The guide image data includes position coordinates for adjusting a display position of the eyesight image photographed with the image pickup section 2*b*.

RAM 5 is used as a work area and includes a register area for temporarily storing various flag data, an eyesight image data area for temporarily storing eyesight image data obtained with the image pickup section 2*b* of HMD 2, a side eyesight image data area for temporarily storing side eyesight image data obtained with the side image pickup section 8, and a guide image data area for temporarily storing guide image data selected and transferred from ROM 4 by operation of a song selecting switch.

Now, the performance instruction procedure will be described with reference to FIG. 18 through FIG. 25. When a process at step SA5 of the main routine operation (FIG. 3) is performed, CPU 3 advances to a process at step SI1 shown in FIG. 18, where a performance evaluation procedure is performed to determine whether or not performance has been performed correctly in accordance with the performance instruction. At steps SI2 through SI5, a wrist position evaluation procedure, a specified point evaluation procedure, a back of hand position evaluation procedure, and a fingertip position evaluation procedure are performed, respectively to determine whether or not the posture of the practitioner's hand is correct for playing the keys of the keyboard. The operations of the procedures set forth above will be described in detail hereafter.

(a) Operation of Performance Evaluation Procedure

Figure 19:
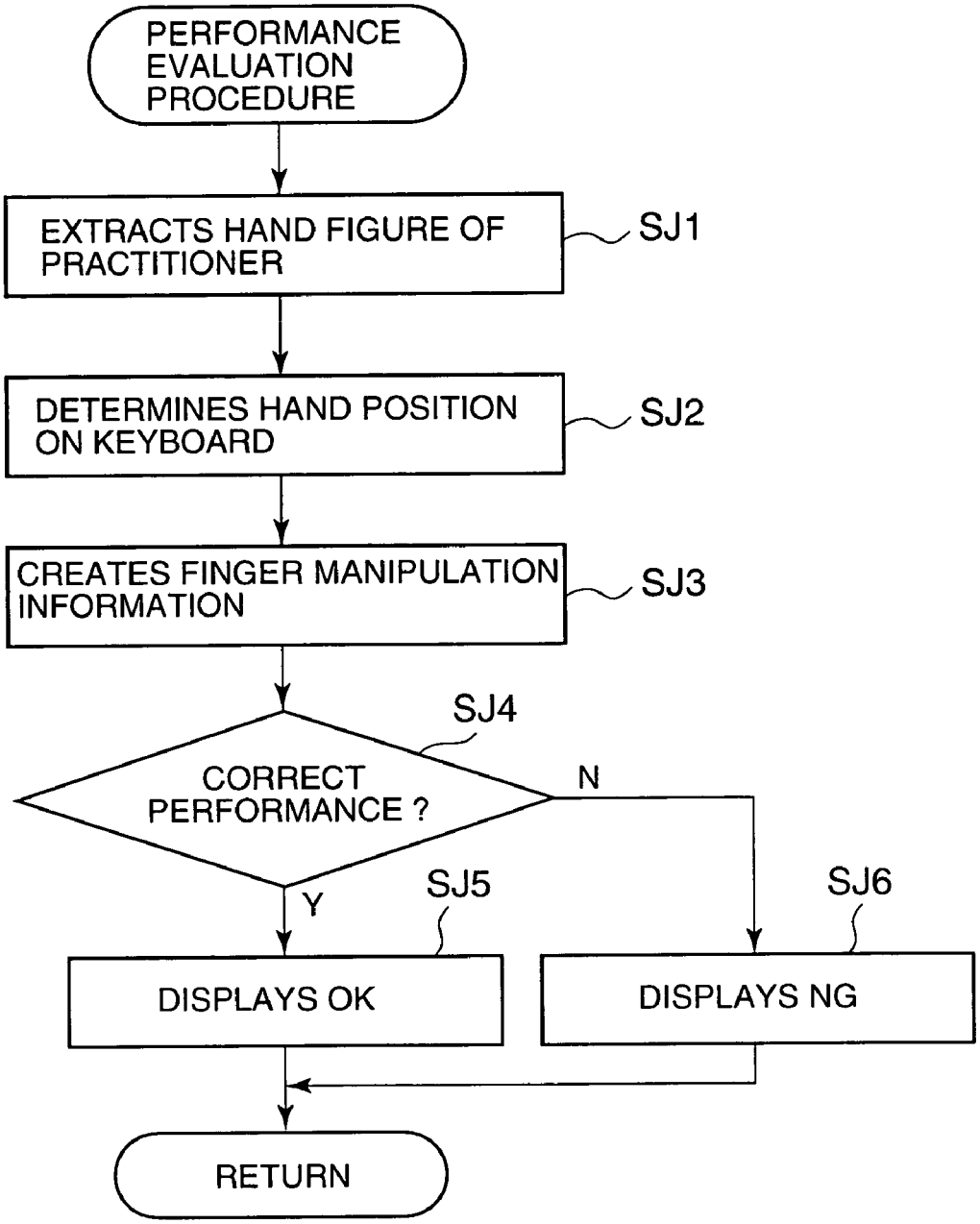
FIG. 19 is a flow chart showing operation of a performance evaluation procedure.

When the process at step SI1 is performed, CPU 3 advances to a process at step SJ1 of FIG. 19, where the eyesight image data stored in the eyesight image data area of RAM 5 is subjected to the image recognition procedure to extract the hand figure of the practitioner. At step SJ2, it is judged on which position (key area) on the keyboard the practitioner's hand is placed. More specifically, with reference to the marks MP written on the upper and lower sides of the keyboard shown in FIG. 6, it is judged on which position on the keyboard the practitioner's hand is placed.

At step SJ3, the eyesight image data is subjected to the image recognition procedure based on the determined hand position to detect the finger playing the key to create the finger manipulation information of the practitioner. At step SJ4, the finger manipulation information of the practitioner and the corresponding finger manipulation information included in the guide image data are compared to determined whether or not the performance manipulation has been performed correctly as instructed in the performance instruction. When it is determined that the performance manipulation has been performed as instructed, the judgment result at step SJ4 is "YES", and CPU 3 advances to a process at step SJ5, where an indication "OK" is displayed on the display section 2*a* of HMD 2, advising that the performance manipulation has been performed correctly as instructed. When it is determined that the performance manipulation has been not performed as instructed, the judgment result at step SJ4 is "NO", and CPU 3 advances to a process at step SJ6, where an indication of "NG" is displayed on the display section 2*a* of HMD 2, advising that the performance manipulation has not been performed correctly as instructed, and the performance evaluation procedure finishes.

(b) Operation of Wrist Position Evaluation Procedure

Figure 20:
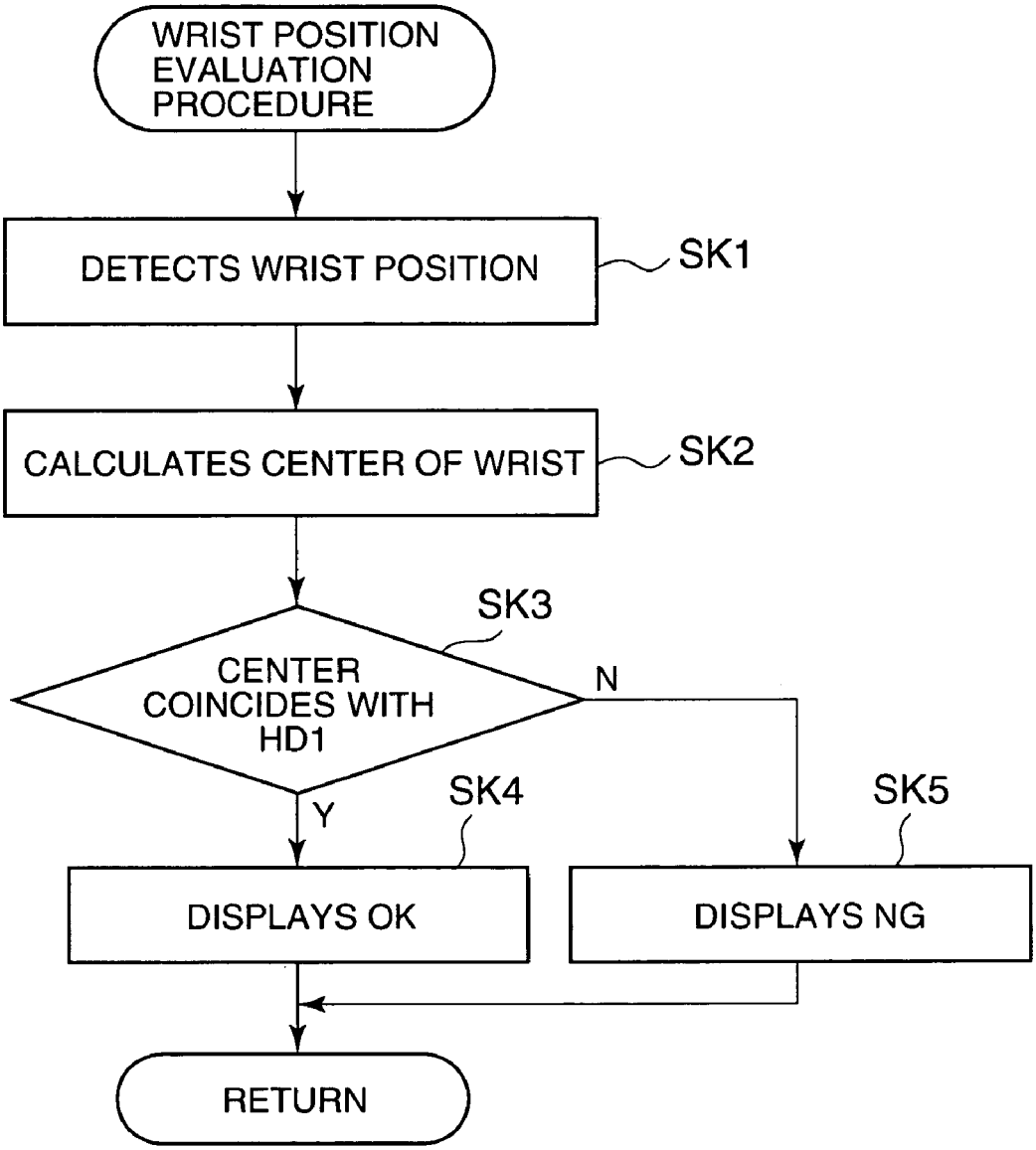
FIG. 20 is a flow chart showing operation of a wrist position evaluation procedure.
Figure 24:
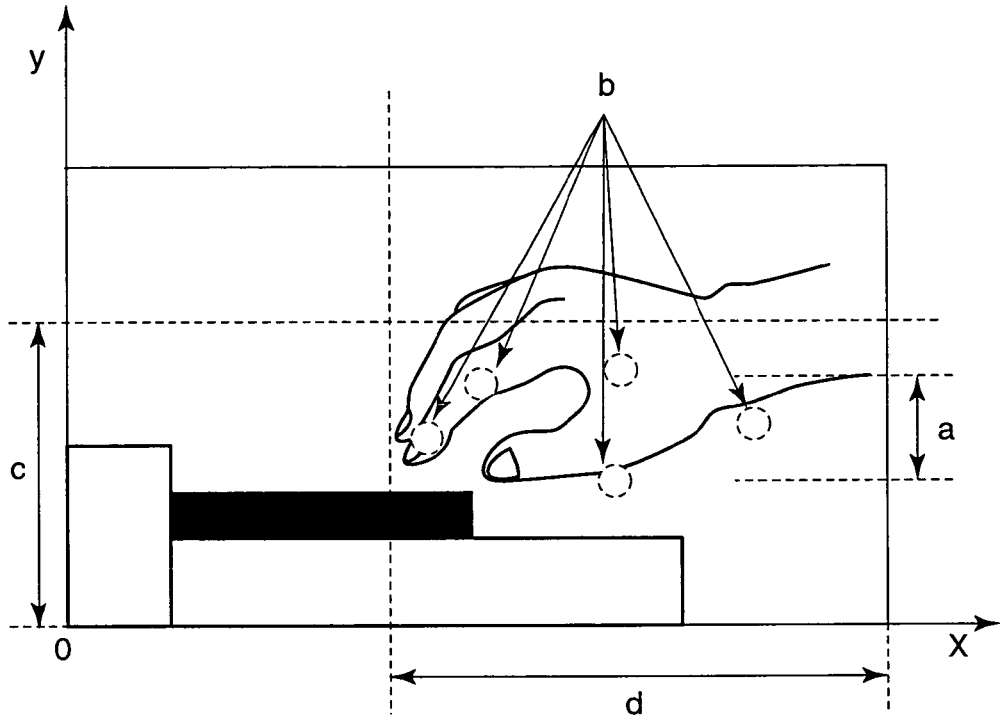
FIG. 24 is a view showing an example of a side eyesight image.
Figure 25:
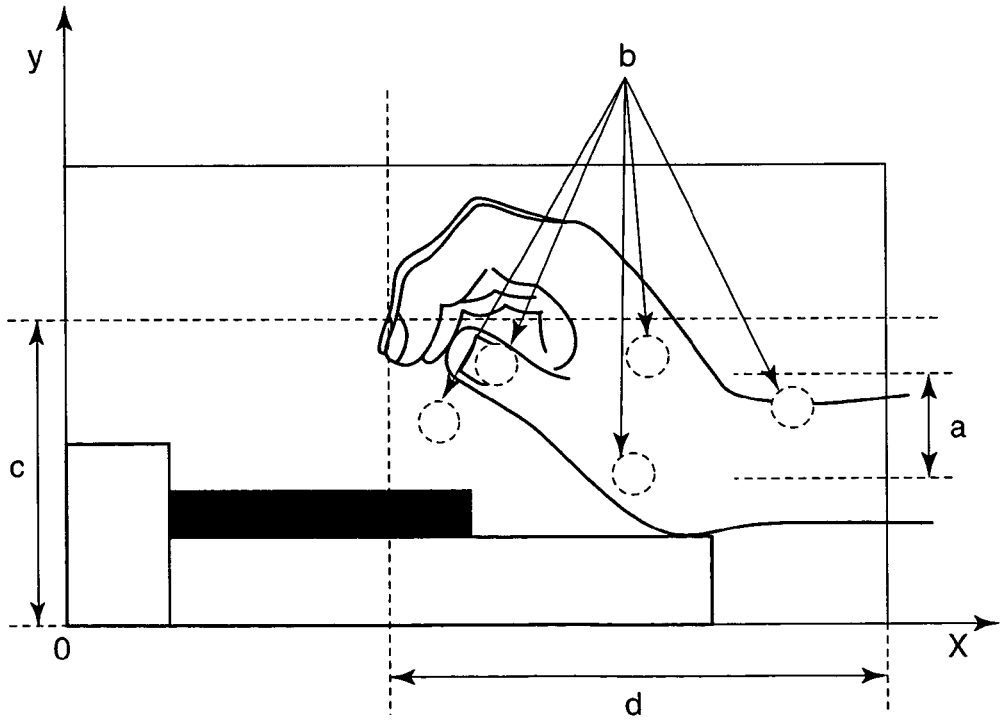
FIG. 25 is a view showing another example of a side eyesight image.

When the process at step SI2 is performed (FIG. 18), CPU 3 advances to a process at step SK1 of FIG. 20, where the side eyesight image data stored in the side eyesight image data area of RAM 5 is subjected to the image recognition procedure to detect an image of the wrist portion of the practitioner from the side eyesight image. At step SK2, a coordinate of a center of the wrist portion is calculated from the coordinates of the top and the bottom of the wrist portion of the practitioner. At step SK3, it is judged whether or not the calculated center coordinate coincides with the data HD2 (FIG. 17*a*) in the judgment data HD corresponding to the performance data PD that is being reproduced at that time, that is, it is judged whether or not the practitioner has placed his/her hand on a correct position of the keyboard. When it is determined that the practitioner has placed his/her hand on a correct position, the result of judgment at step SK3 is "YES", and CPU 3 advances to a process at step SK4, where an indication of "OK" is displayed. When it is determined that the practitioner has not placed his/her hand on a correct position, the result of judgment at step SK3 is "NO", and CPU 3 advances to a process at step SK5, where an indication of "NG" is displayed, and the procedure terminates. Therefore, when the practitioner has placed his/her wrist for example as shown in FIG. 24 or FIG. 25, the indication of "NG" is displayed on the display section 2*a* of HMD 2, advising that the practitioner has not placed his/her wrist on a correct position.

(c) Operation of Specified Point Position Evaluation Procedure

Figure 21:
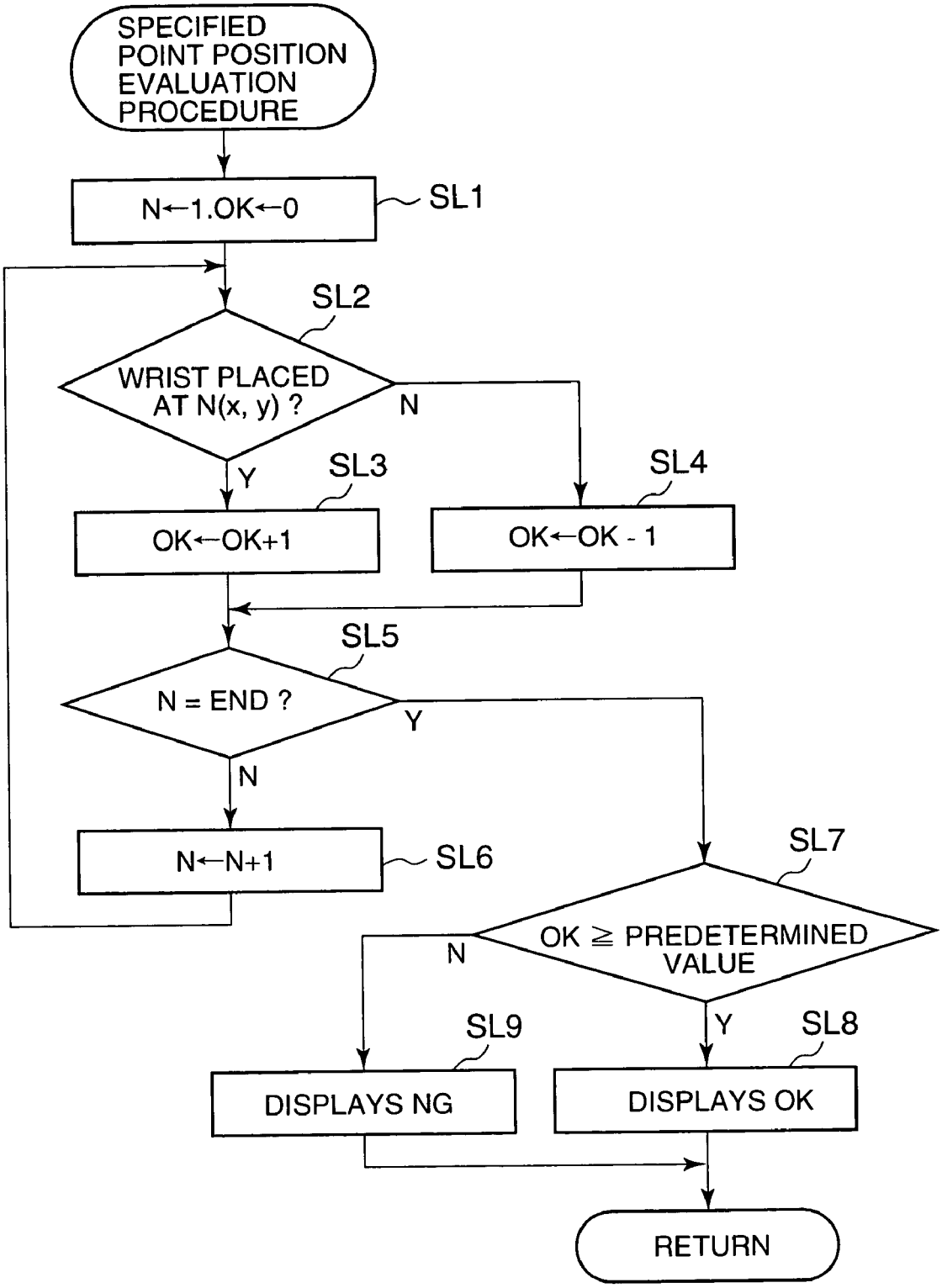
FIG. 21 is a flow chart showing operation of a specified point position evaluation procedure.

When the process at step SI3 (FIG. 18) is performed, CPU 3 advances to a process at step SL1 of FIG. 21, where a register N is set to "1", and a register OK is reset to "0". The register N serves to designate a specified point N consisting data HD3 in the judgment data HD. When the wrist image is place on the coordinates (x, y) corresponding to the specifying point N in the side eyesight image, the register N is incremented. When the wrist image is not place on the coordinate N (x, y) corresponding to the specifying point N in the side eyesight image, the register N is decremented. At step SL2, the side eyesight image data stored in the side eyesight image area of RAM 5 is subjected to the image recognition procedure to determine whether or not the wrist is place on the coordinate N (x, y) corresponding to the specified point N in the side eyesight image.

When it is determined at step SL2 that the wrist is placed on the coordinate N (x, y) corresponding to the specified point N, the result of judgment at step SL2 is "YES", and CPU 3 advances to a process at SL3, where the register OK is incremented. Meanwhile, when it is determined at step SL2 that the wrist is not placed on the coordinate N (x, y) corresponding to the specified point N, the result of judgment at step SL2 is "NO", and CPU 3 advances to a process at SL4, where the register OK is decremented. At step SL5, it is determined whether or not the register N has reached a value of END, that is, whether or not the position of the wrist has been judged with respect to every specified point. When the judgment has not yet completed, the result of judgment at step SL5 is "NO", and CPU 3 advances to a process at step SL6, where the register N is incremented, and then CPU 3 returns to the process at step SL2.

The processes at step SL2 through step SL3 are repeatedly performed until the wrist image has been found correctly at every specified point. When the judgment of position of the wrist image has been completed with respect to every specified point, the result of judgment at step SL5 is "YES", and CPU 3 advances to a process at step SL7, where it is determined whether or not the value of the register OK is more that a predetermined value, that is, it is judged whether or not the practitioner places his/her hand on the keyboard correctly. When it is determined at step SL7 that the practitioner places his/her hand on the keyboard correctly, the result of judgment is "YES", and CPU 3 advances to a process at step SL8, where an indication of "OK" is displayed on the display section 2*a* of HMD 2. Meanwhile, when it is determined at step SL7 that the practitioner does not place his/her hand on the keyboard correctly, the result of judgment is "NO", and CPU 3 advances to a process at step SL9, where an indication of "NG" is displayed on the display section 2*a* of HMD 2. Then the current procedure finishes. Therefore, when the practitioner places his/her hand as shown in FIG. 24 or FIG. 25, the indication of "NG" is displayed on the display section 2*a* of HMD 2, advising that the wrist is not placed correctly.

(d) Operation of Back of Hand Position Evaluation Procedure

Figure 22:
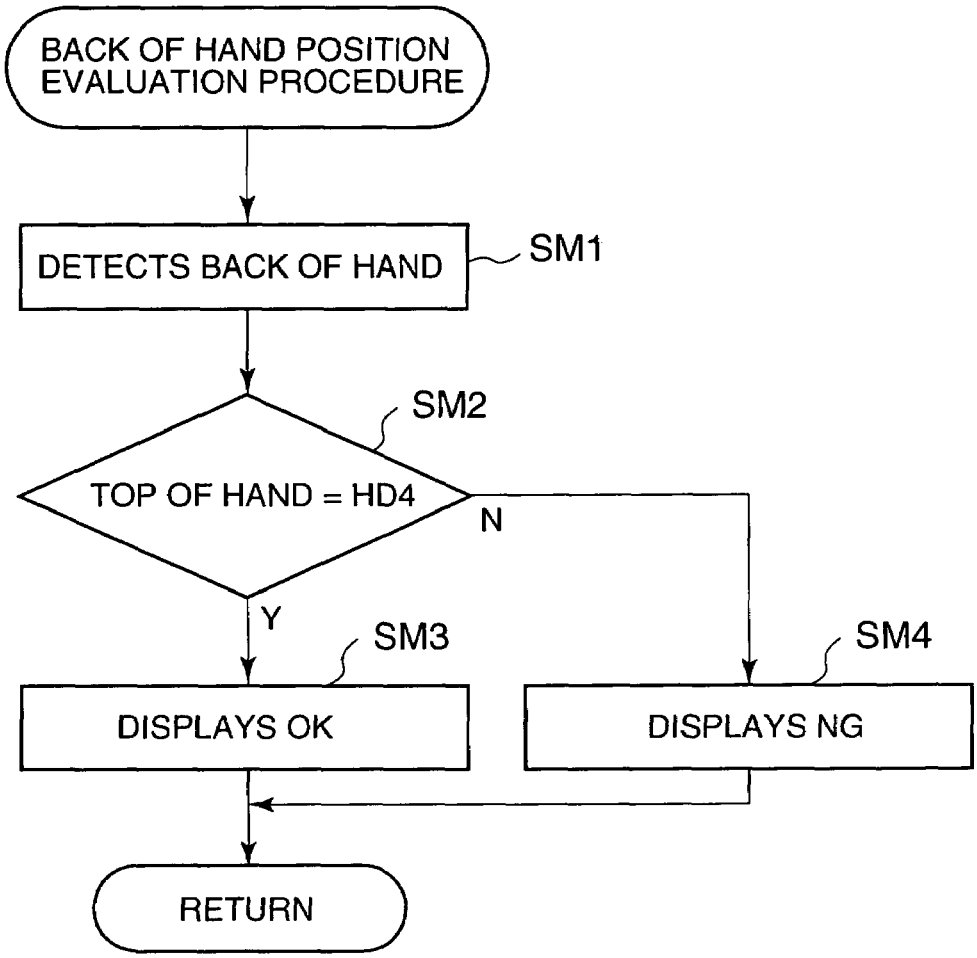
FIG. 22 is a flow chart showing operation of a back of hand position evaluation procedure.

When the process at step SI4 (FIG. 18) is performed, CPU 3 advances to a process at SM1 shown in FIG. 22, where the side eyesight image data stored in the side eyesight image data area of RAM 5 is subjected to the image recognition procedure to detect the back of hand of the practitioner in the side eyesight image. At step SM2, it is determined whether or not the top position (coordinates) of the back of the practitioner's hand in the side eyesight image coincides with data HD 4 (FIG. 17*a*) in the judgment data HD corresponding to the performance data PD which is being reproduced at present, that is, it is judged whether or not the practitioner places his/her hand correctly. When it is determined at step SM2 that the practitioner has placed his/her hand on the keyboard correctly, the result of judgment is "YES", and CPU 3 advances to a process at step SM3, where an indication of "OK" is displayed on the display section 2*a* of HMD2, advising that the practitioner has placed his/her hand correctly on the keyboard. Meanwhile, when it is determined at step SM2 that the practitioner has not placed his/her hand correctly, the result of judgment is "NO", and CPU 3 advances to a process at step SM4, where an indication of "NG" is displayed on the display section 2*a*. Then, the procedure finishes. When the practitioner has placed his/her hand as shown in FIG. 24 or FIG. 25, then the indication of "NG" is displayed on the display section 2*a* of HMD 2.

(e) Operation of Fingertip Position Evaluation Procedure

Figure 23:
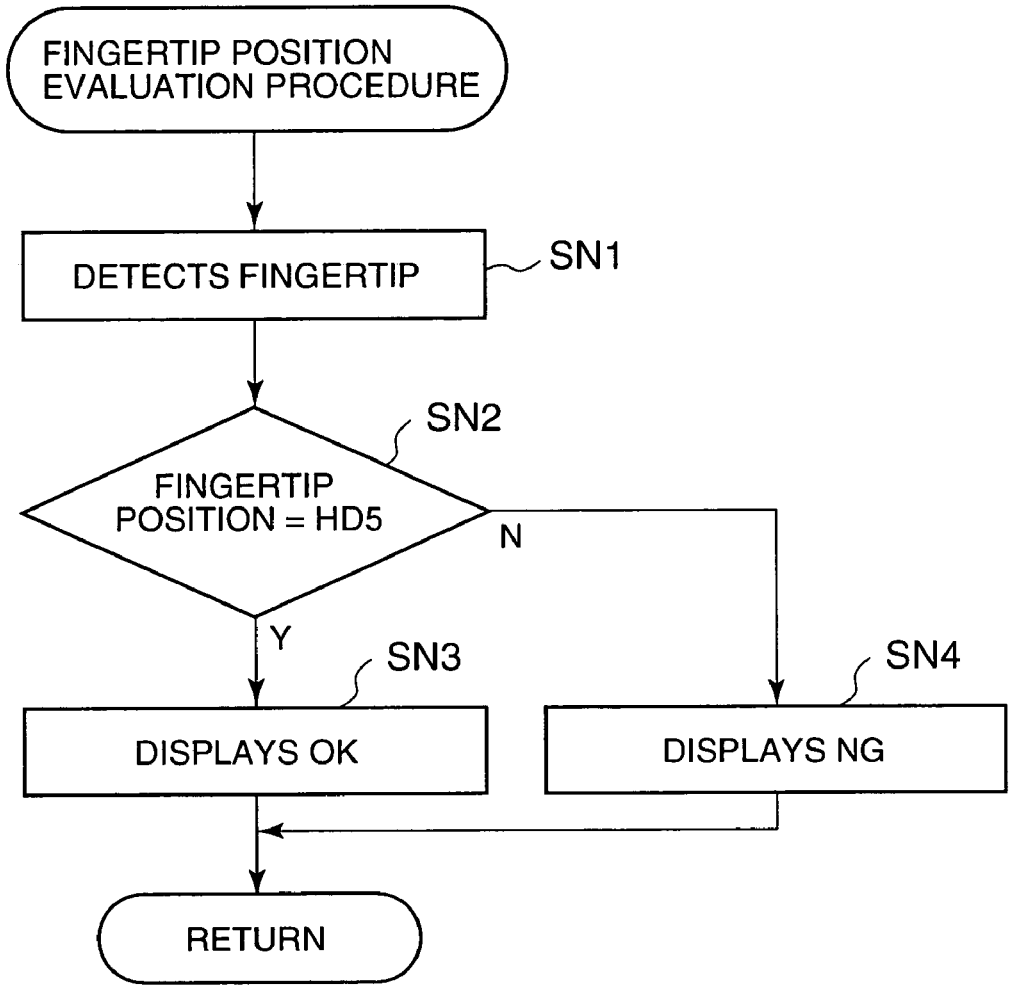
FIG. 23 is a flow chart showing operation of a fingertip position procedure.

When the process of step SI5(FIG. 18) is performed, CPU 3 advances to a process at step SN1 shown in FIG. 23, where the side eyesight image data stored in the side eyesight image data area of RAM 5 is subjected to the image recognition procedure to detect the fingertip of the practitioner in the side eyesight image. At step SN2, it is determined whether or not the position (coordinates) of the fingertip the practitioner in the side eyesight image coincides with data HD 5 (FIG. 17*a*) in the judgment data HD corresponding to the performance data PD which is being reproduced at present, that is, it is judged whether or not the practitioner places his/her fingertip correctly. When it is determined at step SM2 that the practitioner has placed his/her fingertip correctly, the result of judgment is "YES", and CPU 3 advances to a process at step SN3, where the indication of "OK" is displayed on the display section 2*a* of HMD2, advising that the practitioner has placed his/her fingertip correctly. Meanwhile, when it is determined at step SN2 that the practitioner has not placed his/her fingertip correctly, the result of judgment is "NO", and CPU 3 advances to a process at step SN4, where the indication of "NG" is displayed on the display section 2*a*. Then, the procedure finishes.

In the fourth embodiment described above, when the practitioner wearing the goggle type HMD 2 begins the practice, he/she can view on the display section 2*a* of HMD 2 the guide image showing the model performance manipulation superimposed on his/her eyesight image, and meanwhile, it is judged whether or not the practitioner has correctly placed his/her wrist, the back of his/her hand, the specified points on his/her hand, and the fingertips on the keyboard so as to conform to the model performance manipulation. Therefore, the practitioner can learn the correct posture of his/her hand on the keyboard.

In the fourth embodiment, the CCD camera 8*a* installed on the left side to of the keyboard and the CCD camera 8*b* installed on the right side of the keyboard are used to photograph the side eyesight images showing how the practitioner plays the keyboard, and positions of various parts of the practitioner's hands on the keyboard such as the wrist, the specified points, the back of the hand and the fingertips are detected from these side eyesight images to determine whether the practitioner has placed his/her hands on the keyboard correctly. Alternatively, the following modification to the embodiment will be possible. For example, the shadow of the practitioner who is playing the keyboard is photographed from one side with the light illuminated from the other side, and the positions of various parts of the practitioner's hands on the keyboard such as the wrist, the back of the hand, the specified points on the hand, and the fingertips are detected from the photographed shadow of the practitioner to determine whether the practitioner has placed his/her hands on the keyboard correctly. Further modification and variation can be made to the disclosed embodiments without departing from the subject and spirit of the invention as defined in the following claims. Such modification and variations, as included within the scope of these claims, are meant to be considered part of the invention as described.

What is claimed is:

1. A performance instruction apparatus comprising:

goggle-type teaching equipment for use by a practitioner;

a display section provided on the teaching equipment;

an image memory for storing a guide image comprising an image representative of a hand of the practitioner playing a musical instrument and information for indicating a key to be played of a keyboard of the musical instrument and for teaching the practitioner how to manipulate his/her fingers to play keys of the keyboard;

an image pickup section provided on the teaching equipment for capturing an image of at least the keyboard of the musical instrument and the hand of the practitioner playing the keyboard, so as to generate an eyesight image corresponding to an eyesight of the practitioner; and an adjusting section for reading out the guide image from the image memory and adjusting a size and a position of the read out guide image, and for displaying on the display section the eyesight image generated by the image pickup section and the adjusted guide image in a superimposed manner to indicate the key to be played and to teach the practitioner how to manipulate his/her finger to play the key;

wherein, when a difference between the eyesight image and the guide image exceeds a predetermined value, the adjusting section determines that the practitioner has intentionally shifted his/her eye from the keyboard and ceases the superimposition of the guide image on the eyesight image on the display screen, and when the difference between the eyesight image and the guide image does not exceed the predetermined value, the adjusting section adjusts a resolution of the guide image in accordance with the difference between the guide image and the eyesight image and superimposes the adjusted guide image on the eyesight image.

2. A performance instruction apparatus comprising:

goggle-type teaching equipment for use by a practitioner;

a display section provided on the teaching equipment;

an image memory for storing a plurality of guide images, each comprising an image representative of a hand of the practitioner playing a musical instrument and information for indicating a key to be played of a keyboard of the musical instrument and for teaching the practitioner how to manipulate his/her fingers to play keys of the keyboard;

an image pickup section provided on the teaching equipment for capturing an image of at least the keyboard of the musical instrument and the hand of the practitioner playing the keyboard, so as to generate an eyesight image corresponding to an eyesight of the practitioner;

a key number detecting section for detecting a number of keys from the keyboard image included in the eyesight image;

a selecting section for selecting a guide image from among the plurality of guide images stored in the image memory that includes a same number of the keys as detected by the key number detecting section; and an adjusting section for reading out the selected guide image from the image memory and adjusting a size and a position of the read out guide image, and for displaying on the display section the eyesight image generated by the image pickup section and the adjusted guide image in a superimposed manner to indicate the key to be played and to teach the practitioner how to manipulate his/her finger to play the key.

3. The performance instruction apparatus as defined in claim 2, wherein the key number detecting section detects a number of black keys from the keyboard image included in the eyesight image.

4. The performance instruction apparatus as defined in claim 2, wherein the key number detecting section detects a number of white keys from the keyboard image included in the eyesight image.

5. The performance instruction apparatus as defined in claim 2, wherein the key number detecting section calculates the number of the keys of the keyboard based on a ratio of a length in a crosswise direction of the keyboard image to a length in a lengthwise direction of the keyboard image.

6. The performance instruction apparatus as defined in claim 2, wherein, when a key is played by the practitioner, the key number detecting section detects a pitch of a sound of the played key and a position of the played key in the eyesight image, and the key number detecting section calculates the number of the keys based on the detected pitch and the detected key position of the played key.

7. A performance instruction apparatus comprising:

goggle-type teaching equipment for use by a practitioner;

a display section provided on the teaching equipment;

an image memory for storing a guide image comprising an image representative of a hand of the practitioner playing a musical instrument and information for indicating a key to be played of a keyboard of the musical instrument and for teaching the practitioner how to manipulate his/her fingers to play keys of the keyboard;

an image pickup section provided on the teaching equipment for capturing an image of at least the keyboard of the musical instrument and the hand of the practitioner playing the keyboard, so as to generate an eyesight image corresponding to an eyesight of the practitioner; and a transforming section for transforming a number of colors and a number of pixels of at least a part of the eyesight image generated by the image pickup section based on a number of colors and a number of pixels of the guide image read out from the image memory, and for displaying on the display section the transformed eyesight image and the guide image in a superimposed manner to indicate the key to be played and to teach the practitioner how to manipulate his/her finger to play the key.

8. The performance instruction apparatus as defined in claim 7, wherein the transforming section changes the number of colors and the number of pixels of the eyesight image based on the information in the guide image for indicating a key to be played and for teaching the practitioner how to manipulate his/her fingers to play the keys of the keyboard of the musical instrument.

9. The performance instruction apparatus as defined in claim 7, wherein said at least a part of the eyesight image transformed by the transforming section comprises an image of the hand of the practitioner included in the eyesight image generated by the image pickup section.

10. The performance instruction apparatus as defined in claim 7, wherein said at least a part of the eyesight image transformed by the transforming section comprises an image of the keyboard included in the eyesight image generated by the image pickup section.

11. The performance instruction apparatus as defined in claim 7, further comprising:

a display control section which changes a display mode of an image area of a superimposed portion when the transformed eyesight image and the guide, image read out from the image memory are displayed on the display section, and when an image of the hand of the practitioner included in the eyesight image and an image of the hand of the practitioner included in the guide image are displayed in a superimposed manner.

12. A performance instruction apparatus comprising:

a memory for storing judgment data for defining positions of a wrist, predetermined points of a hand, a back of the hand, and at least one fingertip to show model performance manipulation to show a model posture of a hand of a practitioner playing a musical instrument, and for judging, in synchronization with progress of performance of a song, a posture of the hand of the practitioner;

an image pickup section for capturing an image of a side of the hand of the practitioner to obtain a side eyesight image;

an extracting section for extracting an image of the hand of the practitioner from the side eyesight image; and a judging section for periodically judging, in synchronization with the progress of the performance of the song, whether or not the extracted image of the hand of the practitioner coincides with the model shown based on the stored judgment data at the positions of the wrist, the predetermined points of the hand, the back of the hand, and the fingertip, and for advising the practitioner of a judgment result.

13. A performance instruction method for use in a performance instruction apparatus, wherein the performance instruction apparatus comprises a memory for storing judgment data defining positions of a wrist, predetermined points of a hand, a back of the hand, and at least one fingertip to show model performance manipulation to show a model posture of hand manipulation of a practitioner playing a musical instrument in synchronization with progress of performance of a song, said method comprising:

capturing an image of a side of a hand of the practitioner to obtain a side eyesight image of the practitioner;

extracting an image of the hand of the practitioner from the obtained side eyesight image; and judging periodically, in synchronization with the progress of the performance of the song, whether or not the extracted image of the hand of the practitioner coincides with the model posture of hand manipulation shown based on the stored judgment data at the positions of the wrist, the predetermined points of the hand, the back of the hand, and the fingertip, and advising the practitioner of a judgment result.

14. A computer readable storage medium having a performance instruction program stored thereon to be executable by a computer of a performance instruction apparatus, wherein the performance instruction apparatus comprises: (a) goggle-type teaching equipment for use by a practitioner, (b) a display section provided on the teaching equipment, (c) an image memory for storing a guide image comprising an image representative of a hand of the practitioner playing a musical instrument and information for indicating a key to be played of a keyboard of the musical instrument and for teaching the practitioner how to manipulate his/her fingers to play keys of the keyboard of, and (d) an image pickup section provided on the teaching equipment for capturing an image of at least the keyboard of the musical instrument and the hand of the practitioner playing the keyboard, so as to generate an eyesight image corresponding to an eyesight of the practitioner, said program being executable by the computer to cause the computer to execute a process comprising:

transforming a number of colors and a number of pixels of at least a part of the eyesight image generated by the image pickup section based on a number of colors and a number of pixels of the guide image read out from the guide memory to generate a transformed eyesight image; and controlling the display section so as to display the transformed eyesight image and the guide image in a superimposed manner to indicate the key to be played and to teach the practitioner how to manipulate his/her finger to play the key.

15. A computer readable storage medium having a performance instruction program stored thereon to be executable by a computer of a performance instruction apparatus, wherein the performance instruction apparatus comprises: (a) an image pickup section for capturing an image of a side of a practitioner playing a musical instrument to obtain a side eyesight image, and (b) a memory for storing judgment data defining positions of a wrist, predetermined points of a hand, a back of the hand, and at least one fingertip to show model performance manipulation for showing a model posture of hand manipulation of the practitioner in synchronization with progress of performance of a song, said program being executable by the computer to cause the computer to execute a process comprising:

extracting an image of a hand of the practitioner from the obtained side eyesight image; and judging periodically, in synchronization with the progress of the performance of the song, whether or not the extracted image of the hand coincides with the model posture of hand manipulation shown based on the stored judgment data, and advising the practitioner of a judgment result.

16. A computer readable storage medium having a performance instruction program stored thereon to be executable by a computer of a performance instruction apparatus, wherein the performance instruction apparatus comprises: (a) goggle-type teaching equipment for use by a practitioner, (b) a display section provided on the teaching equipment, (c) an image memory for storing a guide image comprising an image representative of a hand of a practitioner playing a musical instrument and information for indicating a key to be played of a keyboard of the musical instrument and for teaching the practitioner how to manipulate his/her fingers to play keys of the keyboard of the musical instrument, and (d) an image pickup section provided on the teaching equipment for capturing an image of at least the keyboard of the musical instrument and the hand of the practitioner playing the keyboard, so as to generate an eyesight image corresponding to an eyesight of the practitioner, said program being executable by the computer to cause the computer to execute a process comprising:

reading out the guide image from the image memory;

adjusting a size and a position of the read out guide image; and controlling the display section to display the generated eyesight image and the adjusted guide image in a superimposed manner to indicate the key to be played and to teach the practitioner how to manipulate his/her finger to play the key;

wherein, when a difference between the eyesight image and the guide image exceeds a predetermined value, it is determined that the practitioner has intentionally shifted his/her eye from the keyboard and the superimposition of the guide image on the eyesight image on the display screen is ceased, and when the difference between the eyesight image and the guide image does not exceed the predetermined value, a resolution of the guide image is adjusted in accordance with the difference between the guide image and the eyesight image and the adjusted guide image is superimposed on the eyesight image.

17. A computer readable storage medium having a performance instruction program stored thereon to be executable by a computer of a performance instruction apparatus, wherein the performance instruction apparatus comprises: (a) goggle-type teaching equipment for use by a practitioner, (b) a display section provided on the teaching equipment, (c) an image memory for storing a plurality of guide images, each comprising an image representative of a hand of a practitioner playing a musical instrument and information for indicating a key to be played of a keyboard of the musical instrument and for teaching the practitioner how to manipulate his/her fingers to play keys of the keyboard of the musical instrument, and (d) an image pickup section provided on the teaching equipment for capturing an image of at least the keyboard of the musical instrument and the hand of the practitioner playing the keyboard, so as to generate an eyesight image corresponding to an eyesight of the practitioner, said program being executable by the computer to cause the computer to execute a process comprising:

detecting a number of keys from the keyboard image included in the eyesight image;

selecting a guide image from among the plurality of guide images stored in the image memory that includes a same number of the keys as detected by the key number;

reading out the selected guide image from the image memory;

adjusting a size and a position of the read out guide image; and controlling the display section to display the generated eyesight image and the adjusted guide image in a superimposed manner to indicate the key to be played and to teach the practitioner how to manipulate his/her finger to play the key.

* * * * *